US008960111B2

(12) United States Patent
Cho

(10) Patent No.: US 8,960,111 B2
(45) Date of Patent: Feb. 24, 2015

(54) APPARATUS AND LOWER THREAD WINDING-SPOOL FOR DETECTING THE ENDING REGION OF LOWER THREAD OF SEWING MACHINE

(75) Inventor: Myung Rai Cho, Yongin-si (KR)

(73) Assignee: Bobbintel Inc. (KR)

( * ) Notice: Subject to any disclaimer, the term of this patent is extended or adjusted under 35 U.S.C. 154(b) by 0 days.

(21) Appl. No.: 13/821,783

(22) PCT Filed: Aug. 11, 2011

(86) PCT No.: PCT/KR2011/005902

§ 371 (c)(1),
(2), (4) Date: Mar. 8, 2013

(87) PCT Pub. No.: WO2012/033289

PCT Pub. Date: Mar. 15, 2012

(65) Prior Publication Data

US 2013/0167763 A1 Jul. 4, 2013

(30) Foreign Application Priority Data

Sep. 9, 2010 (KR) ..... 10-2010-0088529

(51) Int. Cl.

| | |
|---|---|
| ***D05B 59/02*** | (2006.01) |
| ***D05B 51/00*** | (2006.01) |
| ***D05B 59/00*** | (2006.01) |
| *D05B 57/08* | (2006.01) |

(52) U.S. Cl.

CPC ..... *D05B 51/00* (2013.01); *D05B 59/00* (2013.01); *D05B 59/02* (2013.01)

USPC ..... 112/278

(58) Field of Classification Search

CPC ..... B65H 7/00; B65H 7/04; B65H 7/14; B65H 26/00; D05B 59/00; D05B 59/02; D05B 51/00; D05B 57/26; D05B 57/28

USPC ..... 112/270, 278, 273, 279, 302, 475.01, 112/475.02; 242/118, 563; 250/559.11, 250/559.12, 559.14

See application file for complete search history.

(56) References Cited

U.S. PATENT DOCUMENTS

| | | | | | |
|---|---|---|---|---|---|
| 2,910,555 | A | * | 10/1959 | Tunstall | 200/61.15 |
| 3,129,680 | A | * | 4/1964 | Doerner | 112/278 |
| 3,991,692 | A | * | 11/1976 | Papajewski et al. | 112/278 |
| 4,250,825 | A | * | 2/1981 | Kamiyama | 112/278 |

(Continued)

FOREIGN PATENT DOCUMENTS

| | | |
|---|---|---|
| JP | 526080 | 4/1993 |
| KR | 20030031097 | 4/2003 |

(Continued)

OTHER PUBLICATIONS

International Search Report—PCT/KR2011/005902 dated Apr. 4, 2012.

*Primary Examiner* — Ismael Izaguirre

(74) *Attorney, Agent, or Firm* — Cantor Colburn LLP

(57) ABSTRACT

A lower thread ending region detection apparatus prevents problems associated with false stitchings occurring from inability to detect lower thread's exhaustion during sewing operation. The lower thread ending region detection apparatus comprises: light control unit, which contacts a part of lower thread wound on a thread bobbin and activates or inactivates at least one of the functions of emitting light, reflecting light, passing light and blocking light, due to the effect of the physical movement force generated depending on whether the lower thread of the ending region is unwound; light receiving unit, which receives the light transferred out by the light control unit and outputs a detection signal; and control and notification unit, which analyzes the detection signal output from the light receiving unit to determine whether the lower thread has reached the ending region and outputs the result to the user.

37 Claims, 15 Drawing Sheets

(56) References Cited

U.S. PATENT DOCUMENTS

| | | | | | |
|---|---|---|---|---|---|
| 4,569,298 | A | * | 2/1986 | Lindh et al. | 112/278 |
| 5,211,121 | A | * | 5/1993 | Sakakibara | 112/278 |
| 5,570,646 | A | * | 11/1996 | Mardix et al. | 112/278 |
| 5,788,171 | A | | 8/1998 | Okabayashi | |

FOREIGN PATENT DOCUMENTS

| | | |
|---|---|---|
| KR | 200377813 | 2/2005 |
| KR | 200435370 | 1/2007 |
| KR | 100824346 | 4/2008 |

* cited by examiner

APPARATUS AND LOWER THREAD WINDING-SPOOL FOR DETECTING THE ENDING REGION OF LOWER THREAD OF SEWING MACHINE

TECHNICAL FIELD

The present invention relates to a sewing machine, specifically in regards to an apparatus that is able to easily and accurately detect the situation at which the lower thread (or bottom thread or bobbin thread) wound on a thread bobbin (pre-wound bobbin or lower thread bobbin) has reached the ending region and the situation at which the lower thread has been broken; and lower thread winding-spools which support the function of the apparatus.

BACKGROUND ART

Since the thread bobbin, once stored in a bobbin case (abbreviated as BC in the present invention), rests under the compartment of the sewing machine, the operator is unable to see it during sewing operation. Therefore, faulty stitchings happen due to being unable to see and detect the exhaustion or breakage of lower thread during sewing operation, and results in inferior quality or re-work of sewing operation. As a result, production cost may increase or productivity may decrease. In order to solve such problems, there is a need for an apparatus that detects the situation at which there is only a small amount of lower thread left before being completely exhausted (i.e. the lower thread has reached the ending region), and an apparatus that detects the thread bobbin's rotation in order to determine the situation of the lower thread being broken.

Previous methods used to detect whether the lower thread has reached the ending region and whether the thread bobbin rotates included 1) detecting conductive material painted on the lower thread's ending region, 2) detecting fluorescent material painted on the lower thread's ending region, 3) sticking a light reflective tape or a light polarizing reflective tape to the bobbin core, on which the lower thread is wound, and detecting whether the light illuminated from outside is reflected, 4) sticking a bar code tape to the bobbin core, on which the lower thread is wound, and reading if the bar code once appears, 5) sticking a bobbin rotation detection mark to the bobbin's sidewall flange and determining the change in the rotation direction of the thread bobbin, or 6) sticking a bobbin rotation detection mark to the bobbin's sidewall flange and determining the number of rotations or the rotation speed of the thread bobbin.

For the methods detecting the conductive material or the fluorescent material painted on the lower thread's ending region, some processes such as painting the conductive or fluorescent material on a certain length from the end of the lower thread and drying the material are additionally required to the existing process of winding the lower thread on bobbin cores or bobbins. Therefore, these methods are extremely wasteful in terms of time as well as labor force, and thus, production costs increase while productivity decreases and additional quality related problems occur. Furthermore, these methods do not provide any means of detecting the thread bobbin's rotation in order to determine the situation of the lower thread being broken, and thus, an entirely separate device and mechanism must be additionally used.

The methods sticking a light reflective tape, a light polarizing reflective tape, or a bar code tape (these are collectively termed as reflecting tape hereinafter) to the bobbin core and detecting the light reflected from the reflecting tape, which is exposed when the lower thread is almost exhausted, are nearly impossible to be used for existing sewing machines. This is because there is no space to attach a light emitting unit and a light receiving unit inside the BC, and it is very inconvenient to install the electric wire that delivers the output signal from the light receiving unit to an alerting device outside. Therefore, these light units have to be installed on the front of the BC or the back of the hook device; thus, the light emitting unit must accurately illuminate light at a very steep angle onto the small cylindrical bobbin core (diameter 0.7~0.8 Cm, length 0.8~0.9 Cm), which is located at the bobbin spindle inside the BC, through the small hole or space that has been formed on the BC or hook device; and the light receiving unit must be aligned so that it is able to accurately receive the light reflected back from only the bobbin core; these are all very difficult to do in actuality. Specifically, as the BC's interior wall possesses a smooth surface made of a metallic substance, it is very difficult to accurately illuminate light onto the reflective tape attached on the small cylindrical bobbin core and accurately detect the reflected light without scattering of reflection. Furthermore, as severe shaking occurs during the sewing operation, it becomes very difficult for the two light units to remain accurately aligned with the reflective tape attached on the small cylindrical bobbin core. In actuality, if such methods were to be employed, the existing sewing machine structure would have to undergo drastic modification, or the hook device as well as the BC and other numerous existing devices used in the sewing machine must be exchanged with specially designed products, resulting in expensive costs and thus, make them almost impossible to be used for existing sewing machines. In addition, these methods do not provide any means of detecting the thread bobbin's rotation in order to determine the situation of the lower thread being broken.

By the way, the automation process of sticking the reflecting tape to the bobbin core is not only difficult but very expensive in terms of production costs. That is, it is very difficult in actuality to completely automate the process of sticking an extremely small reflective tape one by one to a cylindrical bobbin core made of plastic material; therefore, not only a lot of labor force is required, but also a lot of quality related problems are generated during the process, and results in the production costs being much greater than those of the process using just bobbin core made of plastic material. In addition, as the lower thread has to be wound on the slippery reflecting tape during the thread winding process, the lower thread will be wound unevenly and results in the occurrence of an additional quality related problem.

For the methods attaching a bobbin rotation detection mark on the side of the thread bobbin and detecting the change in the rotation direction of the thread bobbin, a certain length of lower thread from its end must be wound in one direction and then in the opposite direction from there on after during the process of winding lower thread on the bobbin core or bobbin. These methods must not only modify the existing lower thread winding process, in which the lower thread was wound in only one direction, but also exchange all existing machines of winding lower thread, and additionally invoke severe quality related problems that occur as the already wound lower thread unravels during the process of winding in the opposite direction.

The methods attaching a rotation detection mark on the bobbin's sidewall flange and determining the number of rotations or the rotation speed of the thread bobbin are fundamentally unable to accurately detect the ending region of the lower thread. Since, these methods may determine that the lower thread has reached the ending region, even though there is a lot of lower thread left, thus resulting in the waste of a lot of lower thread; or may not even detect it until the lower thread has been completely exhausted. The reasons are that the operator does not maintain a constant motor speed during sewing operation, and that the sudden start or stop of the motor causes false rotations of the thread bobbin located inside the BC; all of which make it difficult to calculate the rotation speed of the thread bobbin, and thus, there is a large margin for error in detecting the lower thread ending region based on calculating rotation speed. Also, the length of lower thread wound on each of the thread bobbin is not the same; thus, there is a large margin for error in determining the lower thread ending region based on counting the number of thread bobbin's rotation. Besides, these methods are not useful for the thread bobbin which doesn't have a sidewall flange. Therefore, these methods cannot support the recent market trend of industrial sewing machines and embroidery machines, a lot of which use the thread bobbins having only the bobbin core.

As reviewed above, previous methods for determining the situation of the lower thread reaching the ending region and the rotation of the thread bobbin have not been used in markets because of many problems: 1) invoke problems in the process of winding the thread on the bobbin core or the bobbin, 2) increase the production costs of the thread bobbins or quality related problems, 3) difficult to apply to existing sewing machines, 4) do not correctly detect the lower thread ending region of the thread bobbin, or 5) do not provide functions detecting the thread bobbin's rotation for determining the situation of the lower thread being broken.

DETAILED DESCRIPTION OF THE INVENTION

Technical Problem

The present invention provides a lower thread ending region detection apparatus (abbreviated as LTERDA in the present invention), which will solve the aforementioned problems through accurately detecting the situation of the lower thread reaching the ending region as well as the rotation of the thread bobbin; being small, simple and problem-free in applying to existing sewing machines; minimizing production costs; causing no changes to existing thread bobbin production process; and preventing the increase of the thread bobbin production cost or the arise of quality related problems.

The present invention also provides the LTERDA that is able to easily and accurately detect the situation of the lower thread being broken (abbreviated as LTBB in the present invention) in addition to detecting the situation of the lower thread reaching the ending region (abbreviated as LTRER in the present invention).

The present invention also provides a bobbin and bobbin core (which are collectively termed as lower thread winding-spool in the present invention) which support the LTERDA to easily and accurately detect the situation of the LTRER.

Technical Solution

According to an aspect of the present invention, there is provided a lower thread ending region detection apparatus (LTERDA). The LTERDA includes a light control unit (abbreviated as LCU in the present invention), which contacts a part of lower thread wound on a thread bobbin and activates or inactivates at least one of the functions of emitting light, reflecting light, passing or penetrating light, and blocking light, due to the effect of the physical movement force (abbreviated as PMF in the present invention) generated depending on whether the lower thread of the ending region is unwound; a light receiving unit (abbreviated as LRU in the present invention), which receives the light transferred out by the LCU and outputs a detection signal; and a control and notification unit (abbreviated as CNU in the present invention), which analyzes the detection signal output from the LRU to determine whether the lower thread has reached the ending region and outputs the result to the user.

According to another aspect of the present invention, there is provided a lower thread ending region detection apparatus (LTERDA). The LTERDA includes a LCU, which carries out at least one of the functions of emitting light, reflecting light, passing or penetrating light, and blocking light, and is constructed so that it rotates during the usage of a part of lower thread due to the effect of the physical bearing power (abbreviated as PBP in the present invention) of the lower thread if the lower thread of the ending region is still left, while it does not rotate despite the continual usage of the lower thread if the PBP becomes less than a certain level as the lower thread of the ending region is unwound; a LRU, which receives the light transferred out by the LCU and outputs a detection signal; and a CNU, which determines whether the sewing machine motor (abbreviated as SMM in the present invention) rotates by analyzing at least one of the detection signals between the LRU's output signal and a motor rotation sensing output signal; whether the LCU rotates by analyzing the detection signal output from the LRU; and whether the lower thread has reached the ending region based on determinations of both the SMM's rotation and the LCU's rotation; and outputs the result to the user.

According to another aspect of the present invention, there is provided a lower thread winding-spool, which composes a thread bobbin used in the LTERDA. The lower thread winding-spool includes a cylindrical body formed with (or having) a bobbin spindle hole (abbreviated as BSH in the present invention), wherein on the inner surface of the BSH of the cylindrical body, a parking part insertion structure (abbreviated as PPIS in the present invention) is formed to allow a thread bobbin parking part (abbreviated as TBPP in the present invention), which is installed on a rotating plate (abbreviated as RTPL in the present invention) that composes the LTERDA and supports the function of detecting whether a part of lower thread wound on the thread bobbin has reached its ending region or the lower thread has been broken, to be easily inserted.

According to another aspect of the present invention, there is provided a bobbin, which composes a thread bobbin used in the LTERDA. The bobbin includes a cylindrical body formed with (or having) a BSH; at least one side plate fixed to the sides of the cylindrical body; and a tube that is made as a form surrounding at least a portion of the outer surface of the cylindrical body, and is wound with at least a portion of lower thread; wherein a light control panel (abbreviated as LCP in the present invention), composing the LTERDA, is attached or installed or formed on the side plate.

INDUSTRIAL APPLICABILITY

The LTERDA of the present invention can easily and quickly alert the users of existing sewing machines the situation of the LTRER and the LTBB, without altering the structure or exchanging devices of the existing sewing machine, and thus, prevents the users from making false stitchings during sewing operation that result in a great reduction in production costs and a great increase in productivity.

In addition, with the present invention, there is no need to attach a reflective tape or a bar code tape on the bobbin core or bobbin, nor a need to change the existing production process of thread bobbin, and thus will not increase production costs nor generate quality related problems.

Furthermore, the RTPL is made to rotate with the thread bobbin as it is caught onto the inside the BC or the interior hook (abbreviated as IH in the present invention) due to the magnetism of the magnetic substance; and thus, provides the effect of maintaining an even tension during the unwinding of the lower thread wound on the thread bobbin.

BEST MODE OF THE INVENTION

Hereinafter, some preferred embodiments of the present invention will now be explained in detail with reference to the accompanying drawings.

Figure 1:
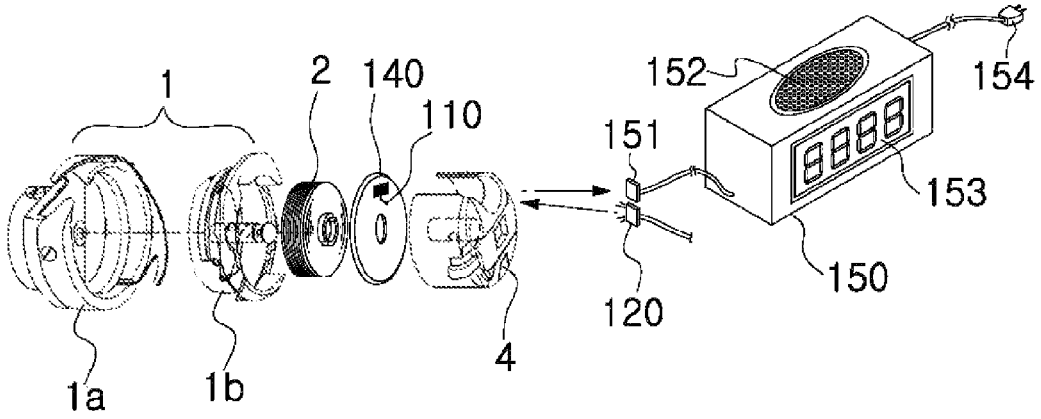
FIG. 1 illustrates an exploded perspective view showing the operating environment of the LTERDA based on the first embodiment of the present invention.

FIG. 1 illustrates the overall operating environment of the LTERDA based on the first embodiment of the present invention.

According to FIG. 1, a hook device 1 is made up of an exterior hook (abbreviated as EH in the present invention) 1*a* and an IH 1*b*; and a thread bobbin 2 combined with a RTPL 140 is stored in a BC 4; and the BC 4 is placed into the IH 1*b*. Thus, the RTPL 140, which is combined with the thread bobbin 2, is located in the inside of the BC 4 and the IH 1*b* (or the components corresponding to the BC 4 or the IH 1*b* in a different structure). FIG. 1 illustrates that the RTPL 140 is located in between the BC 4 and thread bobbin 2, but the RTPL 140 can also be located in between the thread bobbin 2 and IH 1*b*. As the sewing machine operates, the EH 1*a* rotates around the IH 1*b* in which the BC 4 is placed; and the thread bobbin 2 and the RTPL 140 also rotate inside the BC 4 as the lower thread is used. In the present invention, the hook device 1 is not restricted to what is illustrated in FIG. 1, and should be interpreted broadly as including a shuttle, a looper, and so on. In addition, a type of the EH 1*a* that moves back and forth rather than rotating around the IH 1*b* is also included. By the way, in the present invention, the sewing machine is referring to the inclusion of all types of machines that sews cloth, leather, etc.

The LTERDA based on the first embodiment comprises a LCU 110, a light emitting unit (abbreviated as LEU in the present invention) 120, a LRU 151, and a CNU 150. Depending on what the LTERDA comprises, a different embodiment excluding the LEU 120 is also possible; a more detailed explanation about it will be mentioned later.

The LCU 110 comprises one or more LTERCPs and one or more LCPs.

The LTERCP of the LCU 110 is installed on the RTPL 140. Of course, the LTERCP can be also installed on the thread bobbin 2 as well as the later-mentioned FXPL in various ways.

The LCP of the LCU 110 can be implemented with at least one of the following configurations: one type of LCM, multiple types of LCM performing different functions, multiple types of LCM performing the same function but different in wavelength or frequency, multiple types of LCM performing the same function with same wavelength or frequency but different in amount or brightness, and multiple LCM; wherein the LCM perform at least one of the functions of emitting light, reflecting light, passing or penetrating light, and blocking light.

The LCM performing the function of emitting light (i.e. the light emitting means) can be made of, or painted with, or taped with a material or substance that is able to absorb and store the energy of light, heat, pressure, impact, movement, electricity, chemistry, and so on supplied from outside; and is able to emit light on its own for a long time even after the outside energy source has been removed.

For example, the light emitting means can be made of photoluminescent material or phosphorescent material which can self emit light for a long time after it has absorbed the energy of light illuminated from outside. In the present invention, these types of light emitting means are collectively termed as the photoluminescence panel (abbreviated as PHP in the present invention) and there is no limitation or restriction to its material, structure, shape, form, or characteristic.

In the present invention, if the PHP is used and it absorbs the energy of light illuminated from another device that is not associated with the LTERDA, then the LEU 120 does not need to be used.

The LCM performing the function of reflecting light (i.e. the light reflecting means) can be comprised of a reflecting panel, a polarizing reflecting panel, fluorescent panel, prism panel, bar code panel, etc., each of which performs one of the following functions for the light coming in from outside: reflecting light, reflecting fluorescent light, reflecting bar code reading light, and so on. These panels, depending on the angle that light is reflected, can be made as various reflection types such as generic reflection, reflexive reflection, diffused reflection, refracted reflection, and other reflections of various angles. In addition, these panels can be made as one of the following types: reflecting only light having a specific wavelength, absorbing or blocking light having a specific wavelength and reflecting only the remaining light, reflecting light at different rates depending on its wavelength, or reflecting light with different amount, color, or brightness, etc. These light reflecting means can be made of, or painted with, or taped with a certain material or substance. In the present invention, these are collectively termed as the reflecting panel (abbreviated as RFP in the present invention) and there is no limitation or restriction to its material, structure, shape, form, or characteristic.

The LCM performing the function of blocking light (i.e. the light blocking means) can be made of, or formed with, or painted with, or taped with various types of material or substance that performs one of the following functions for the light coming in from outside: obstructing light, absorbing light, blocking light having a specific wavelength range, scattering the reflection of light, reflecting only a very small amount of light, passing a very small amount of light, or blocking light in different ways. In the present invention, these are collectively termed as the blocking panel (abbreviated as BLP in the present invention) and there is no limitation or restriction to its material, structure, shape, form, or characteristic.

The LCM performing the function of passing or penetrating light (i.e. the light penetrating means) can be made of, or formed with, or painted with, or taped with various types of material or substance that performs one of the following functions for the light coming in from outside: simply passing or penetrating the light, passing or penetrating only the light having a specific wavelength range. And these allow the light to be transferred to the opposite side while the RFP or the BLP does not do so. In the present invention, these are collectively termed as the penetrating panel (abbreviated as PNP in the present invention) and there is no limitation or restriction to its material, structure, shape, form, or characteristic.

If the light coming in from outside is illuminated at a portion of the RTPL 140 or the FXPL where none of the PHP, the RFP, the BLP, and the PNP exist, then the light passes through the empty portion. In the present invention, the empty portions that allow the light to pass through are collectively termed as "empty section", and there is no limitation or restriction to its_structure or shape. That is, although the empty portion means the portion or region in which light is passed through, in the present invention, these empty portions also perform the function of passing light; and thus, defined as "empty section" and used as one type of LCM.

In the present invention, the LCP can be made in the form of a thin panel and can be installed or attached onto the side of bobbin core, auxiliary bobbin core, bobbin, side board (all of which compose the thread bobbin 2), the RTPL 140 or the later-mentioned FXPL. In addition, the LCP can also be formed on the bobbin core, auxiliary bobbin core, bobbin, side board (all of which compose the thread bobbin 2), the RTPL 140 or the FXPL. Here, "formed on" means that the LCM, which composes the LCP, is directly formed (or printed or painted) on the side of bobbin core, auxiliary bobbin core, bobbin, side board (all of which compose the thread bobbin 2), the RTPL 140 or the FXPL when each one of these is produced, so that no difference can be detected in the physical appearance.

Therefore, in the present invention, the LCP only needs to be able to perform the function described below, and there is no limitation or restriction to any specific type of physical formation.

In this manner, the LCP can be made as various types of formations; and thus, unless it is explicitly stated in the claims of the present invention that the LCP is implemented as an independent formation that is separate from the RTPL and so on, it should not be restrictively interpreted as that it must only be made as an independent thin plate.

The description regarding the configuration, the formation, and the installation of the LCP of the aforementioned first embodiment of the present invention is identical to the description about the LCP of the later-mentioned second embodiment of the present invention.

In the case that the thread bobbin 2 is combined with the RTPL 140, the LTERCP of the LCU 110 contacts the ending region of the lower thread wound on the thread bobbin 2; depending on whether the lower thread of this region is unwound, at least one of the effects of either the PMF or a change in the PBP is invoked; and due to this effect, the function of the LCM is activated or inactivated. The first embodiment describes mainly about the effect of the PMF of the LTERCP; and the effect of the change in the PBP (that is, the change in the bearing power of the lower thread as the lower thread unwinds) will be described in the later-mentioned second embodiment.

With the invention of these apparatus, the present invention fundamentally eliminates the previous inventions' problem of having to install the LEU 120 and the LRU 151 at very precise angles in order to do the following: precisely illuminate light at a steep angle onto the reflecting tape or the bar code tape adhered on the cylindrical bobbin core that is located at the central axis (bobbin axis) inside the BC 4, and accurately detect only the light reflected from the tape. In addition, the present invention fundamentally eliminates the problem of sticking the reflecting tape or the bar code tape one by one to the small cylindrical bobbin core. That is, the present invention solves the problems of the previous inventions by letting the difference between the inactivation state and activation state of the function of the LCM be clearly and easily detected, due to the effect of either the PMF or the change in the PBP of the LTERCP. The embodiment regarding this will be explained in detail below.

The LEU 120, which illuminates light onto the LCP, can comprise one or more light emitting devices including LED, laser diode, lamp, etc., each of which consumes electricity and emits light such as infrared light, visible light, ultraviolet light, laser light, and other light having various wavelengths; driving devices including driver IC; collecting lenses that collect lights; prisms that change the progression direction of light; and various semiconductor devices that allow a certain data signal to be included in the light. However, there is no limitation or restriction to its material, structure, shape, kinds of component, characteristic, composition, and pattern of signal in the present invention.

FIG. 1 shows the LEU 120 located in front of the BC 4, but depending on the need, the LEU 120 can be located behind the hook device 1 or inside the BC 4 as well. Thus, there is no limitation or restriction to the location of the LEU 120 in the present invention.

The LRU 151 can comprise one or more light receiving devices, which output detection signals after receiving the light emitted, reflected, blocked, penetrated, or passed through by the LCP; driving devices; signal conversion devices; auxiliary light receiving devices that are used to adaptively adjust the level of output signal of the light receiving devices depending on the brightness of the surroundings; collecting caps that collect lights; prisms that change the progression direction of light; and various semiconductor components that can decode a certain data signal from the light. However, there is no limitation or restriction to its material, structure, shape, kinds of component, characteristic, composition, and form in the present invention.

Here, the type of the detection signal output from the LRU 151 includes digital signals or analog signals. For example, the detection signal can be output as a current or voltage in on/off form depending on whether the light is received or not, or in analog form depending on the amount or the brightness of light received, as well as in digital data signal form. However, there is no limitation or restriction to its form in the present invention. Additionally, an analog signal form can be converted into a digital form through a signal conversion device, and this signal conversion device can be located inside the LRU 151 or the CNU 150. In addition, the CNU 150 can include the function of adaptively adjusting the level of the output signal of the LRU 151 depending on the brightness of the surroundings. For example, the CNU 150 can determine the brightness of the surroundings through the output signal by the auxiliary light receiving device and adaptively adjust the level of the detection signal output from the light receiving device which receives light transferred from the LCP.

FIG. 1 shows the LRU 151 located in front of the BC 4, but depending on the need, the LRU 151 can also be located behind the hook device 1.

Therefore, the LEU 120 and the LRU 151 can both be located on the same side as shown in FIG. 1, or they can be located on opposite sides. For example, in the case that the RFP is used as the LCM of the LCP, the LEU 120 and the LRU 151 are located on the same side; while in the case that the PNP is used, the LEU 120 and the LRU 151 are located on opposite sides; and in the case that the BLP is used, the LEU 120 and the LRU 151 can be located on the same side or the opposite side. If the PHP is used as the LCM of the LCP and it emits light on its own, then the LEU 120 may not be needed.

Since the location of the LEU 120 and the LRU 151 can vary in forms, there is no limitation or restriction regarding this in the present invention.

The CNU 150 analyzes the detection signal output from the LRU 151, which receives the light emitted, reflected, passed or penetrated through by the LCM of the LCP; and once the CNU 150 determines whether the lower thread has reached the ending region, the CNU 150 outputs the warning signal to the user through a speaker 152 or a display 153. In addition, the CNU 150 can determine the rotation of the LCP by analyzing the detection signal output from the LRU 151; and the CNU 150 can also determine the rotation of the SMM through various methods, which will be explained in the second embodiment of the present invention; and finally once the CNU 150 determines whether the lower thread has reached the ending region or whether the lower thread has been broken, the CNU 150 outputs the results to the user through the speaker 152 or the display 153. The CNU 150 can be made in a way that it is supplied with electricity from outside through a power line 154.

Figure 2:
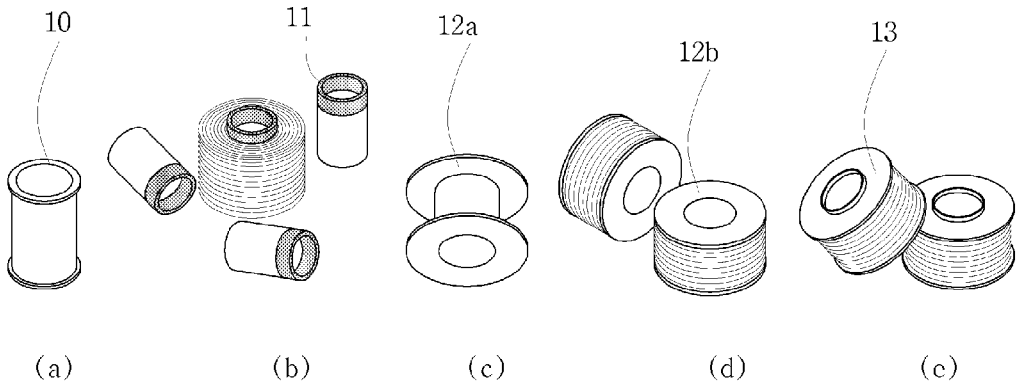
FIG. 2 shows an embodiment of the various components composing the thread bobbin.

FIG. 2 shows an embodiment of the various components composing the thread bobbin 2. A bobbin core 10, a magnetic core 11, a bobbin with sidewall flange 12*a*, a bobbin with side wall 12*b*, and a side board 13, are selectively used during the production of the thread bobbin 2. Side wall (or, sidewall), flange, and sidewall flange are collectively termed as side plate in the present invention. Although it is not shown in FIG. 2, there is an auxiliary bobbin core, as illustrated in FIG. 4D, that is attached to the coreless pre-wound bobbin which does not use the bobbin core 10,11.

That is, the thread bobbin 2 comprises a lower thread winding-spool on which the lower thread is wound. Here, the aforementioned bobbin core 10,11, bobbin 12*a*,12*b*, and auxiliary bobbin core are collectively termed as the lower thread winding-spool in the present invention including all embodiments and patent claims.

The bobbin core 10,11 composing the thread bobbin 2 is formed as a sideless type, which means that it doesn't have a side plate; and the bobbin core 10,11 includes a bobbin core 10 and a magnetic core 11, on both of which the lower thread is wound, and can be called as thread spool or bobbin spool in English depending on the user.

The bobbin 12*a*,12*b* composing the thread bobbin 2 is formed as a sided type, which means that its sides are fixed with the side plate; and the bobbin 12*a*,12*b* is called as bobbin, sided bobbin, sidewall flange bobbin, or flange spool bobbin in English depending on the user.

Figure 3:
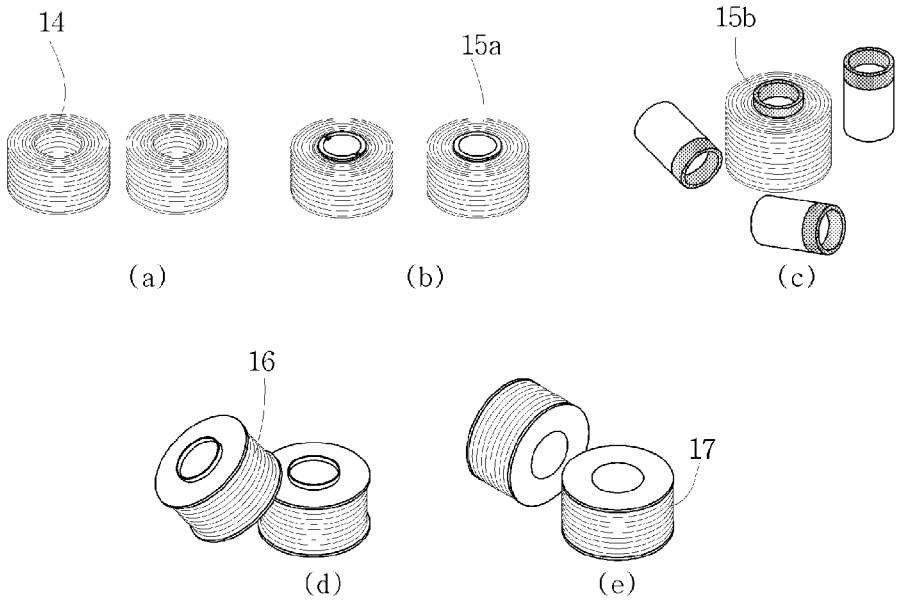
FIG. 3 shows some embodiments of the various types of thread bobbin.

FIG. 3 shows some embodiments of the various types of thread bobbin.

In the present invention, the thread bobbin (pre-wound bobbin or lower thread bobbin) 2 includes all of following types: two types 15*a*,15*b* using only the bobbin core 10,11, a type 16 using the bobbin core 10,11 and side board 13, a type 17 using the bobbin 12*a*,12*b*, and a coreless type 14 without using even the bobbin core; wherein all of which are wound by thread.

Additionally, the thread bobbin 2 includes all types regardless of whether it is a pre-wound bobbin that is produced at the factory or a lower thread bobbin that is wound by the sewing operator.

Figure 4:
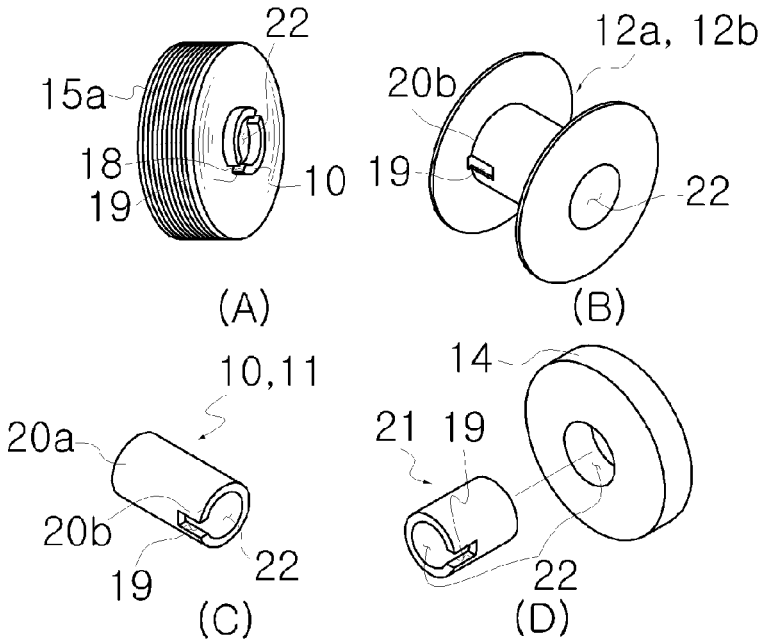
FIG. 4 illustrates some embodiments of the lower thread ending region and the contact groove.

FIG. 4 illustrates some embodiments of the lower thread ending region and the contact groove. Generally the length of the lower thread regarded as the residual amount of the ending region is from a few cm (centimeter) to a few m (meter), or sometimes more, of the thread that is left before the lower thread wound on the thread bobbin 2 is completely exhausted. However, since each user may want a different length, there is no limitation or restriction regarding this in the present invention. The lower thread ending region 18 refers to one or more layers out of any of the several layers of lower thread wound on the bobbin core 10,11 or the bobbin 12*a*,12*b*; wherein, the length of the wound lower thread corresponds to the residual amount of the ending region. In FIG. 4(A), (B), (C), the lower thread ending region 18 refers to the portion, that is easily contacted by the LTERCP, out of the several layers of the wound lower thread corresponding to the length of the residual amount of the ending region. In other words, the lower thread ending region 18 refers to the portion of lower thread wound on the vicinity of one ending region 20*b* of the bobbin core 10,11 or bobbin 12*a*,12*b*.

There are various types of ways that the LTERCP contacts the lower thread of the ending region 18. For example, there is a type in which the LTERCP contacts any of the several layers of lower thread from the first layer wound on the lower thread winding-spool (i.e. bobbin core 10,11, auxiliary bobbin core 21, bobbin 12*a*,12*b*) to the layer wound around the end of the lower thread ending region 18; a type in which the LTERCP contacts any of the several layers of lower thread from the layer wound around the end of lower thread ending region 18 to the several layers wound above it; and a type in which the LTERCP contacts any of the several layers of lower thread wound below and above the layer wound around the end of the lower thread ending region 18. Since the residual amount of the ending region is different depending on the type selected and it is up to the choice of user, there is no limitation or restriction regarding this in the present invention.

The contact groove 19 refers to the opening or aperture, groove or slot, or the hole that is made from one ending region 20*b* to the region slightly inside towards the opposite side 20*a* of the lower thread winding-spool; and the lower thread is wound above the contact groove 19. The contact groove 19 can be made to allow enough space for the physical movement of the LTERCP. Through this space, the LTERCP, which had been contacting below or side of the lower thread of the ending region 18, can physically move due to the restoration of the elasticity when the lower thread of the ending region 18 is unwound. Of course, this is a matter of choice as the LTERCP does not necessarily have to contact the lower thread of the ending region 18 through the contact groove 19. However, if the LTERCP contacts the lower thread through the contact groove 19, then there is a benefit of minimizing the residual amount of the ending region because the LTERCP can physically move when the first layer (that is, the very first wound layer) of the lower thread of the ending region 18 is unwound. Since the contact groove 19 can be made with varying numbers, shapes, sizes, and installation locations, there is no limitation or restriction regarding these in the present invention.

For the coreless bobbins 14 that do not use the bobbin core, as shown in FIG. 3 (A), a special auxiliary bobbin core 21 is used as having been fitted into the BSH 22 of the coreless bobbin 14; wherein the special auxiliary bobbin core 21 is formed with (or having) the contact groove 19. This process is illustrated in FIG. 4 (D).

Figure 5:
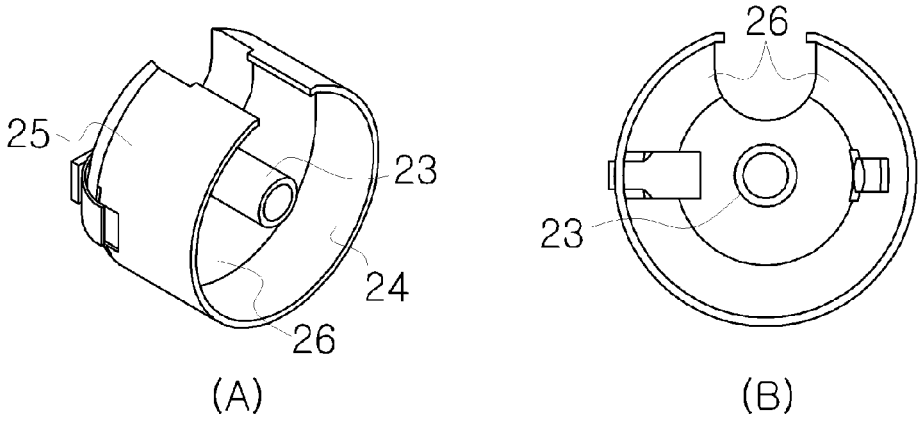
FIG. 5 illustrates a perspective side view (A) showing the BC and a plane view (B) showing the inside of the BC.

FIG. 5 illustrates a perspective side view (A) showing the BC and a plane view (B) showing the inside of the BC. A bobbin spindle 23 protrudes from the BC's inner wall 26. When the thread bobbin 2 and the RTPL 140 is stored in the BC 4, the bobbin spindle 23 is inserted in the BSH 22 of the thread bobbin 2 and the RTPL 140. There is a hole in the center of the bobbin spindle 23, in which the bobbin case supporting-spindle of the hook device 1 is inserted. The BC's interior side 24 refers to the inside wall of the BC 4, and the BC's exterior side 25 refers to the outside wall of the BC 4. The stored RTPL 140 can physically contact the BC's inner wall 26. Of course, the RTPL 140 can also be stored in the BC 4 as RTPL 140 physically contacts the IH 1*b*.

The definition of the BC 4 in the present invention is not only limited to the type shown in FIG. 5 (A) and (B), but the BC 4 can also include a concept of a bobbin cover which is used in the structure without having the bobbin spindle 23. Furthermore, in order to apply the present invention in the structure of hook device 1 that do not use the BC, the BC 4 can also include a concept of an auxiliary bobbin cover formed as a circular plate which is placed in the IH 1*b*.

Hereinafter, in accordance with the LTERDA of the first embodiment, the structure of the RTPL 140 installed with the LCU 110 and the structure of the thread bobbin 2 that combines with the RTPL 140 will be explained in detail.

Although the type of thread bobbin 2 using only the bobbin core 10,11 is mainly described as an example in the explanation of the first embodiment, as mentioned above, the thread bobbin 2 can also include all types that incorporate the magnetic core 11, bobbin with sidewall flange 12*a*, bobbin with side wall 12*b*, and side board 13. Therefore, in each embodiment of the present invention, all of the description and illustration about the bobbin core 10 can also be applied to the magnetic core 11 and the auxiliary bobbin core 21, as well as the bobbins 12*a*,12*b*.

Figure 6A:
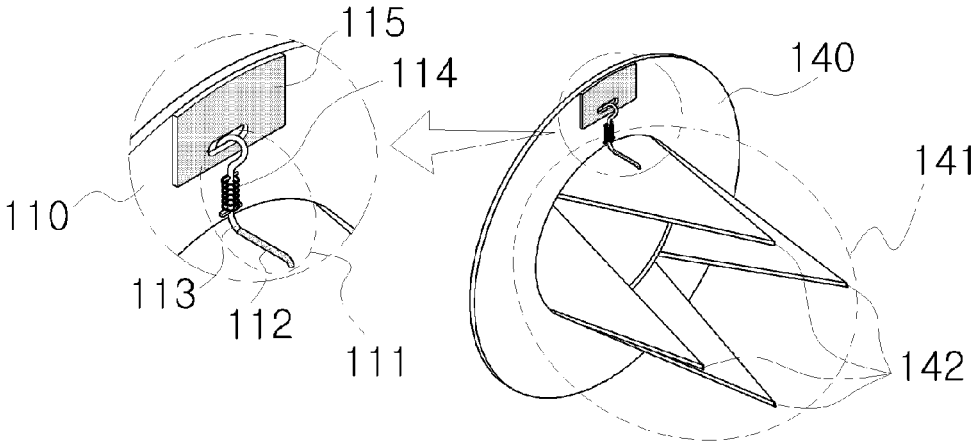
FIGS. 6A-6C illustrate some embodiments of the structures for combining the thread bobbin and the TBPP installed in the RTPL.
Figure 6B:
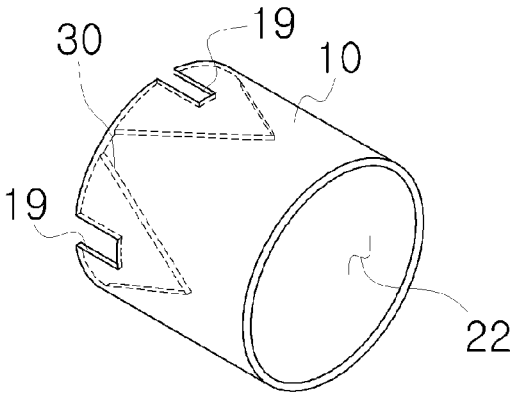
Figure 6C:
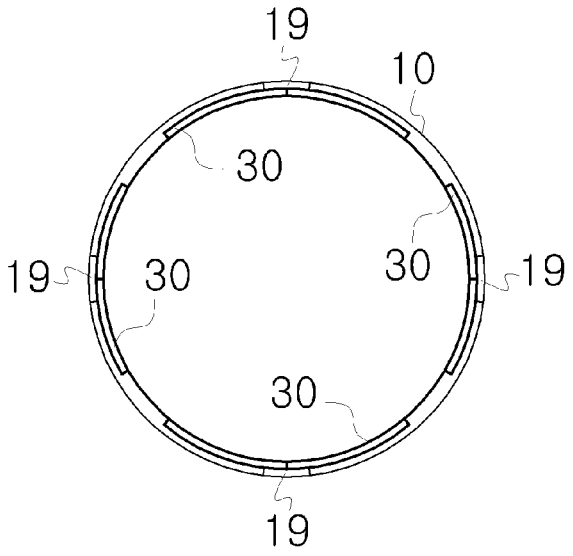

FIGS. 6A-6C illustrate some embodiments of the structures for combining the thread bobbin 2 and the TBPP 141 that is installed on the RTPL 140.

FIG. 6A illustrates a perspective side view showing the RTPL 140, on the side of which the TBPP 141 and the LTERCP 112 of the LCU 110 are installed. The structure and operation of the LCU 110 shown in the figure will be discussed in detail later.

FIG. 6B illustrates a side view showing an embodiment of the bobbin core 10, and FIG. 6C illustrates a front view showing an embodiment of the bobbin core 10; wherein the bobbin core 10 is subject to combining with the TBPP 141.

According to FIG. 6A, the TBPP 141 is installed on one side of the RTPL 140, and is formed to have a bobbin core insertion supporting structure (abbreviated as BCISS in the present invention) 142, which supports the easy and stable combination with the bobbin core 10 when the user combines the bobbin core 10 of the thread bobbin 2 with the RTPL 140. The BCISS 142, as illustrated in FIG. 6A, can be made as a triangular shape with a certain amount of spacing or as other suitable shapes and structures.

The BCISS 142 supports the LTERCP 112 of the LCU 110 so that the LTERCP 112 can stably maintain its contact on the lower thread of the ending region 18 wound on the thread bobbin 2. In the case that the RTPL 140 combines with the bobbin core 10 formed with (or having) the contact groove 19, the BCISS 142 can additionally support the LTERCP 112 so that the LTERCP 112 can precisely align with the contact groove 19.

According to FIGS. 6B-6C, the inner surface of the BSH (that is, the inner wall which borders the BSH 22) of the bobbin core 10, is formed to have the PPIS 30 that has a shape corresponding to the shape of the BCISS 142. That is, the PPIS 30 can be made to correspond to the shape of the BCISS 142; for example, it can be formed as a triangular shape with a certain amount of spacing and with a bump on the inner surface of the BSH.

As mentioned above, in the present first embodiment, the PPIS 30 refers to the structural form, which has been made on the inner surface of the BSH of the bobbin core 10, that corresponds to the structural form of the BCISS 142; so its structure can vary depending on the shape of the BCISS 142. Due to this structural feature, when the user physically combines the thread bobbin 2 with the RTPL 140, it involves the process in which the alignment of the two shapes is induced.

In other words, when the BCISS 142, which is formed on the TBPP 141 of the RTPL 140, is inserted into the PPIS 30, which is formed on the inner surface of the BSH of the bobbin core 10, both of them will come in touch so that the process of the alignment of their shapes can be induced and their combination state can be maintained stably. Therefore, the LTERCP 112 is able to stably contact the lower thread of the ending region 18 wound on the bobbin core 10.

In this way, as the TBPP 141, which is installed on the side of the RTPL 140, is made as a structure that is inserted into and closely combined with the inner surface of the BSH of the bobbin core 10; and thus the RTPL 140 can rotate when the thread bobbin 2 rotates.

In the case of the aforementioned coreless bobbin 14 which does not use the bobbin core 10, the auxiliary bobbin core 21 can be inserted into the BSH 22 of the thread bobbin 2 and then combined with the TBPP 141.

Since the BCISS 142 and the PPIS 30 can be formed with varying shapes, sizes, structures, materials, and numbers in the technical spirit of the present invention, there is no limitation or restriction regarding these in the present invention.

The structure and operation of the LCU 110 of the LTERDA based on the first embodiment will be explained in detail below.

The LCU 110 comprises at least one of the LTERCPs 112 and at least one of the LCPs. And, a LCP is implemented with at least one of the LCM. Therefore, the LCU 110 comprises several LCMs.

According to FIG. 6A, not only the LTERCP 112, but also the LCM 115 is installed in the RTPL 140. As mentioned above, the LCP implemented with the LCM 115 can be made in the form of a thin panel and attached to the RTPL 140, or can be formed on the RTPL 140. In this case, the RTPL 140 carries out the role of the LCP.

Here, the LTERCP 112 can also be installed in the later-mentioned FXPL and the thread bobbin 2; also, the LCM 115 can be installed on the FXPL and thread bobbin 2. That is, not only the RTPL 140, but the FXPL and the thread bobbin 2 can also carry out the role of the LCP. Especially, since the LCU 110 can comprise of several LCPs, the several LCMs 115 can be distributed onto the RTPL 140, FXPL, and thread bobbin 2 in various configurations. Therefore, the LTERCP 112 and the LCM 115 can be installed as one of the following configurations: all installed on only one among the RTPL 140, the FXPL, and the thread bobbin 2; distributed onto the RTPL 140 and the FXPL; distributed onto either one of the FXPL or the RTPL 140, and the thread bobbin 2; all distributed onto the FXPL, the RTPL 140, and the thread bobbin 2.

Figure 12:
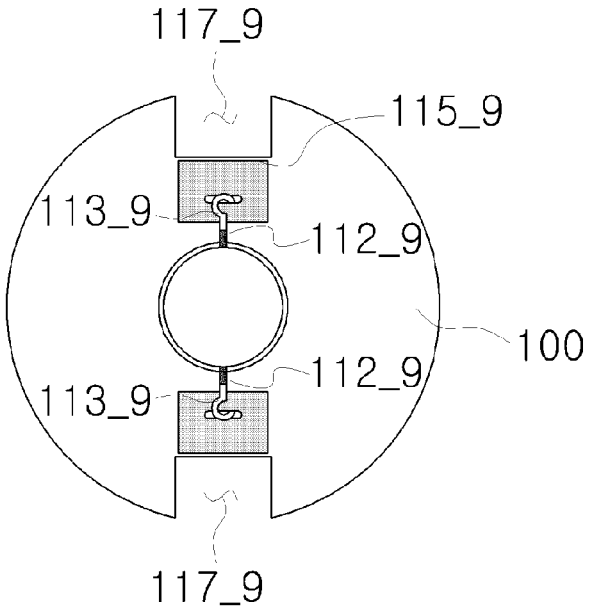
FIG. 12 illustrates an embodiment of the structure in which both the LTERCP and the LCM are installed on the FXPL.
Figure 13:
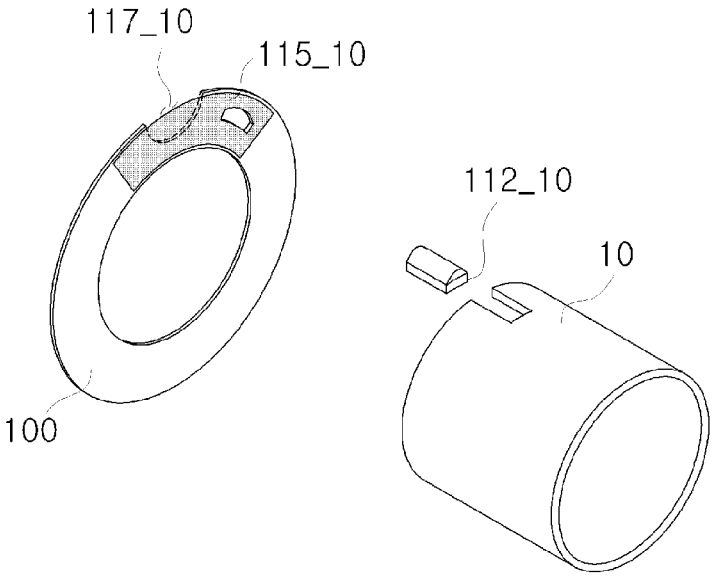
FIG. 13 illustrates an embodiment of the structure in which the LTERCP and the LCM are distributed onto the thread bobbin and the RTPL or the FXPL.

The configuration in which both the LTERCP 112 and the LCM 115 are installed in only one of either the RTPL 140 or the thread bobbin 2 is illustrated in FIGS. 7A-7C and FIGS. 8A-8C; while, the configuration in which these are distributed onto the RTPL 140 and the FXPL is illustrated in FIGS. 9A-9C and FIG. 10; while, the configuration in which these are installed on only the FXPL is illustrated in FIG. 12; and the configuration in which these are distributed onto the FXPL, the RTPL 140, and the thread bobbin 2 is illustrated in FIG. 13.

The following is an explanation of the operation of the LTERCP 112 in reference to the combined state of the RTPL 140 and the bobbin core 10.

Figure 7A:
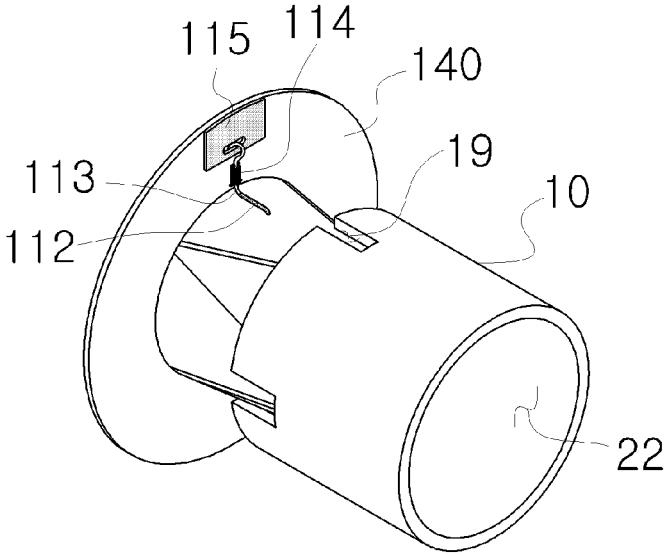
FIG. 7A illustrates an embodiment of the process of combining the RTPL and the thread bobbin.
Figure 7B:
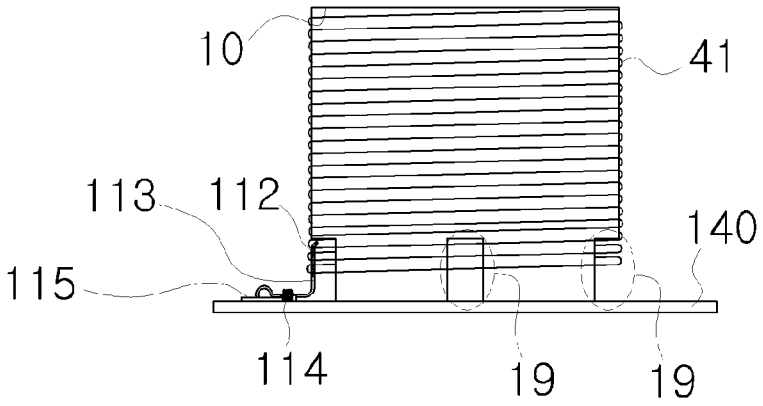
FIGS. 7B-7C illustrate side views of embodiment of the structure, in which the RTPL and the thread bobbin are combined, showing that the lower thread ending region contacting part (abbreviated as LTERCP in the present invention) changes in position due to the effect of the PMF of the LTERCP.
Figure 7C:
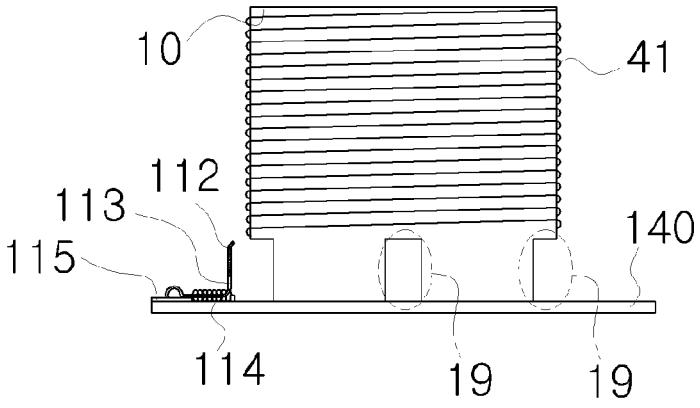

First, FIG. 7A illustrates a perspective view showing the process of combining the RTPL 140 and the bobbin core 10 that composes the thread bobbin 2; and FIGS. 7B-7C illustrate the side views showing the state after the combination. Since FIG. 7A is an illustration to show just the combining process, it does not show the lower thread wound on the outer surface of the BSH (i.e. the outer wall of the BSH 22) of the bobbin core 10. While FIGS. 7B-7C illustrate the lower thread 41 in order to explain the effect of the PMF of the LTERCP 112 when the lower thread is unwound; wherein, the contact groove (s) 19 of the bobbin core 10 has been shown in an open form to help make it easy to understand the process of the physical movement of the LTERCP 112.

The LTERCP 112 physically contacts the lower thread of the ending region 18 wound on the thread bobbin 2. As the LTERCP 112 changes in position due to the effect of the PMF that is generated depending on whether the lower thread of the ending region 18 is unwound, the LTERCP 112 activates or inactivates the function of the LCM 115 that composes the LCP.

As shown in FIG. 7A, the LTERCP 112 is connected to a connecting part 113, and the connecting part 113 can be made from a material like a steel-wire that has appropriate elasticity. Or the connecting part 113 can be made as a form that is attached or fitted with a material like a spring 114 that has appropriate elasticity as shown in FIG. 7A. The LTERCP 112 protrudes outwards from the surface of the RTPL 140 (including the surface of the TBPP 141), and gently contacts the side surface of the lower thread of the ending region 18, which is wound on the bobbin core 10 that composes the thread bobbin 2. If the LTERCP 112 contacts the lower thread of the ending region 18 through the contact groove (s) 19 formed on the bobbin core 10, the LTERCP 112 can also contact the bottom surface of the lower thread as well as the side surface. Specifically, the LTERCP 112 can contact the first wound layer of the lower thread of the ending region 18 and thus minimize the residual amount of the lower thread. Although all embodiments of the present invention used a bobbin core 10 formed with (or having) the contact groove (s) 19 and the first layer of lower thread wound above the contact groove (s) 19, a bobbin core 10 without having contact groove (s) 19 can also be used in the same way. However, in the case that the contact groove (s) 19 is not used or in the case that the bobbin core 10 without having the contact groove (s) 19 is used, the LTERCP 112 can contact only the side surface of the lower thread of the ending region 18 wound in several layers. That is, it is only necessary that the LTERCP 112 is made to be able to physically contact either the side surface or the bottom surface of the lower thread of the ending region 18; and that the LTERCP 112 is made as a form in which a PMF generates an effect (for example, elasticity is compressed or restored) depending on whether the lower thread of the ending region 18 is unwound.

As described, since the connecting part 113 possesses elasticity, the LTERCP 112 also possesses elasticity; thus, depending on whether the lower thread of the ending region 18 is unwound, the elasticity is suppressed or restored, and thus the effect of the PMF is generated. Here, of course, the LTERCP 112 and the connecting part 113 can be made as one body, and one side of the LTERCP 112 can be made to be attached to the TBPP 141. Also, the connecting part 113 can be made of an elastic material with spring-like function; or the connecting part 113 can be made as a form having no elasticity or no elastic part 114 at all. Although FIGS. 7A-7C use an elastic part 114 to help make it easy to understand the PMF of the LTERCP 112, the PMF of the LTERCP 112 can be acquired through the resisting power of the lower thread, even without using the elastic part 114. In addition, there can be one or more numbers of the LTERCP 112. Since the LTERCP 112, the connecting part 113 and the elastic part 114 can be formed with varying numbers, shapes, sizes, structures, materials, characteristics, and operation methods in the technical spirit of the present invention, there is no limitation or restriction regarding these in the present invention.

FIGS. 7B-7C explain the process of the effect of the PMF that causes the LTERCP 112, which had been contacting the bottom surface of the lower thread 41 of the ending region 18 through the contact groove (s) 19 before the lower thread 41 was unwound, to change in position towards the outer direction of the contact groove (s) 19 when the lower thread of the ending region 18 is unwound.

FIG. 7B illustrates the LTERCP 112, which is installed on the RTPL 140, being pushed down along with the connecting part 113 due to the resisting power of the lower thread 41 when the lower thread 41 of the ending region 18 is still left.

That is, the state, in which the connecting part 113 changes in position towards the inner space of the contact groove (s) 19, is maintained by the lower thread 41. At this point, as the spring 114 is compresses, the spring 114 gains restoring force to restore back to its original state; and the restoring force of the spring 114 and the force of the LTERCP 112 being pushed down by the lower thread 41 strike a balance.

FIG. 7C illustrates the result of the physical movement of the LTERCP 112, which is installed on the RTPL 140, when the lower thread 41 of the ending region 18 is unwound.

That is, if the lower thread 41 of the ending region 18, which had been contacted by the LTERCP 112, is unwound, then the resisting power of the lower thread 41 disappears; thus, the PMF of the LTERCP 112 comes to effect due to the restoring force of the spring 114; as a result, the position of the LTERCP 112 changes from the inside of the contact groove 19 to the outside.

As the position of the LTERCP 112 changes due to the effect of the PMF of the LTERCP 112 and the connecting part 113, the LCM 115 also changes in position or alters in form; as a result, the function of that LCM 115 is activated or inactivated.

And, as the LTERCP 112 changes in position, the function of the LCM 115 is activated or inactivated, thus the LCM 115 can emit, reflect, block, or pass or penetrate light out. Then the LRU 151 receives the light transferred out by the LCM 115 and outputs a detection signal to the CNU 150; as a result, the situation in which the lower thread 41 of the ending region 18 is unwound (i.e. the situation of the LTRER) can be easily and accurately detected. This process will be explained in detail later on.

In the present invention, the definition of a certain function of the LCM 115 composing the LCP being activated or inactivated, is that the function of the LCM 115 is carried out or not carried out, respectively. For example, in the case that the RFP is used as the LCM 115, if the RFP is located where the light is illuminated and thus reflects the light, then the function of the RFP is said to be activated; but if the LCM 115 is located where the light is not illuminated and thus can not reflect light, then the function of the LCM 115 is said to be inactivated. In other words, the activation and inactivation of the function of the RFP can be regulated depending on the position of the LCM 115.

On the other hand, if a certain LCM 115 which composes the LCP is continuously located where the light is illuminated but cannot carry out the function of the LCM 115 because the light is temporarily blocked by an outside factor which does not compose the LCP, then the function of the LCM 115 is defined as still being in an activated state rather than an inactivated state in the present invention. Because the mentioned LCM 115 continues to be located where the light is illuminated; and because if the position of the outside factor temporarily blocking the light changes, then the function of the mentioned LCM 115 can be immediately carried out. For example, in the case that the LEU 120, which is located at the side of or behind the rotating EH 1*a*, illuminates the light to the IH 1*b*, where the RTPL 140 installed with a RFP is stored, if the RFP moves to the place where the light is illuminated due to the rotation of the RTPL 140, then the function of the RFP is defined as becoming an activated state in this present invention. In this case, if a hole formed on the EH 1*a* becomes located on top of the RFP and thus, the light from the LEU 120 can illuminate the RFP, then the reflecting function of the RFP is carried out and thus, the light is transferred out; but, if the wall of the EH 1*a* becomes located on top of the RFP and thus, the light from the LEU 120 is blocked, the reflecting function of the RFP cannot be carried out and thus, the light is not transferred out; however, the function of the RFP is still defined as being continuously maintained in an activated state in the present invention. This is because the EH 1*a* is defined as an outside factor, which does not compose the LCP nor the LCM 115 that composes the LCP, in the present invention for the sake of convenience.

To list another embodiment for the aforementioned case, there is a configuration in which both a BLP and a RFP are used as the LCM 115 that composes the LCP, and the RFP is always fixed where the light is illuminated, while the BLP can change in position. If the BLP moves to the location where the RFP is, then the function of the RFP is defined as becoming an inactivated state because the light is blocked by the BLP; but, if the BLP moves away from the location where the RFP is, then the function of the RFP is defined as becoming an activated state.

That is, even though the effects (of the two aforementioned cases) of blocking the light that illuminates the RFP may be the same, the present invention distinguishes the case of the light being blocked by the BLP from the case of the light being blocked by the outside factor; thus, only if the function of LCM 115 and/or the other LCM 115 is carried out or not carried out by only the LCM 115 that composes the LCP, then the function of the LCM 115 is defined as becoming activated or inactivated, and its state is defined as becoming an activated state or inactivated state.

In other words, when the LCP is implemented, the activated state and the inactivated state of the LCM can be defined or regulated by the configuration of the LCP itself; that is, as shown in the aforementioned embodiment, in the case that multiple LCMs are implemented on the LCP, the activated state and the inactivated state of each LCM can be defined or regulated depending on the relative location of each LCM; thus, even though a certain LCM's function is not carried out (for example, the light reflected from the RFP cannot be delivered to the LRU) because of the outside factor (for example, the wall of the rotating EH 1*a*), the activated state and the inactivated state of the LCM is defined by the current state of the LCM (that is, by the relative location of each LCM in the case that multiple LCMs are implemented).

Regardless of whether the light is unable to be transferred out by the BLP that composes the LCP, or by an outside factor that does not compose the LCP, the LRU 151 is unable to receive light and thus it outputs the same detection signal. However, the CNU 150 can differentiate whether the light was blocked by the BLP or an outside factor like the EH 1*a* by using various analyzing methods. This will be introduced through the second embodiment of the present invention explaining the various detection methods of determining the rotation of the SMM.

As mentioned in the previous embodiment, in the case that both the BLP and the RFP are used together, if the BLP moves to the location where the RFP is, then the function of the BLP is activated while the function of the RFP is inactivated; if the BLP moves away from where the RFP is located, then the function of the BLP is inactivated while the function of the RFP is activated.

Like in the aforementioned embodiment, if the function of a certain LCM becomes activated or inactivated, then the function of another LCM can be inactivated or activated.

By the way, even in situations in which the thread bobbin 2 does not rotate normally because of the lower thread breakage or the exhaustion of lower thread, the thread bobbin 2 or the RTPL 140 can slowly rotate due to the shaking of the BC 4 or the IH 1*b* in some sewing machines, which have been produced with such a structure that makes the BC 4 or the IH 1*b* shake severely during the rotations of the SMM. Thus, the LCP, which has been installed on the side of the thread bobbin 2 or the RTPL 140, can also rotate slowly as well; and as a result, the function of the LCM 115 implemented on the LCP can be activated or inactivated depending on whether it moves into or out of an area where light is illuminated. This phenomenon can also occur when the LCP (i.e. the RTPL 140 or the thread bobbin 2) no longer rotates as the lower thread of the ending region 18 is unwound in the present invention.

In the case that the LCP is rotating normally as the lower thread is used, the LCM 115 periodically alternates repetitively between the state of activation and inactivation in proportion to the number of rotations of the SMM; meanwhile, in the case that the LCP rotates only due to the shaking of the BC 4 or the IH 1*b*, the LCM 115 changes between the state of activation and inactivation slowly, without any set period, and disproportionately to the number of rotations of the SMM. Therefore, even though the state of the LCM 115 changes through this phenomenon, it is defined that the CNU 150 of the present invention determines that the LCM 115 does not repetitively alternate between the state of activation and inactivation, and thus, determines that the rotation of the LCP is not detected.

Actually, the aforementioned phenomenon may or may not occur depending on the type of sewing machine and its structure, and the type of BC 4 and its structure, and whether supplemental parts (such as a spring or a magnet that increases the resisting power to the rotation of the thread bobbin) are used. In addition, the LTERCP 112 can restrain the rotation of the LCP (i.e. the RTPL or the thread bobbin) through its physical movement when the lower thread of the ending region 18 is unwound; and thus the LTERCP 112 can restrain the LCP (i.e. the RTPL or the thread bobbin) from rotating due to the shaking of the BC 4 or the IH 1*b*. This will be mentioned in the embodiment of FIG. 9B. By the way, the aforementioned number of rotations of the SMM can be determined by the CNU 150 through various methods of detecting the rotation of the SMM, which will be explained in the second embodiment of the present invention.

All of the aforementioned definitions have been prescribed to prevent misunderstanding and confusion in describing the contents and patent claims of the present invention as well as in conveying the meaning of the description; and thus the definitions are applied, in the same manner, to all of the embodiments of the present invention.

By the way, although FIGS. 7B-7C illustrate the first layer of lower thread 41 of the ending region 18 wound on the bobbin core 10 to be left or being unwinding; but if the elasticity of the LTERCP 112 is strong, then the aforementioned restoration process of the elasticity can occur even though several layers of lower thread 41 are left. In other words, by adjusting the elasticity of the elastic part 114, the detection time of the unwinding of the lower thread 41 can be selected. For example, the LTERCP 112 can change in position due to the restoration of the elasticity when two layers of lower thread 41 of the ending region 18 are left. This type of composition or movement can be applied, in the same manner, to all of the embodiments of the present invention.

By the way, in the aforementioned embodiment, the LTERCP 112 contacts the bottom surface of the lower thread 41 (i.e. the surface on the opposite side of the surface that the lower thread is wound on the thread bobbin 2), but it can also contact the side surface of the lower thread 41 (i.e. the surface that is perpendicular to the surface that the lower thread is wound on the thread bobbin 2).

In the case of using this type of structure, when the thread bobbin 2 and the RTPL 140 are combined, the resisting power of the lower thread 41 is generated and exerts a pressure that produces the PMF to the LTERCP 112; thus, the LTERCP 112 changes in position; and it results in directly or indirectly changing the position of the LCM 115 or alters the form of the LCM 115, or maintaining the changing of its position and the altering of its form. And when the lower thread 41 of the ending region 18 is unwound, the resisting power of the lower thread 41 disappears; and as a result, the LTERCP 112 loses the PMF and no longer directly or indirectly changes the position of the LCM 115 or alters the form of the LCM 115, nor maintains the changing of its position and the altering of its form.

In other words, even though there is no elastic part 114 or elasticity in the connecting part 113, the position of the LTERCP 112 can be changed due to the existence of the resisting power of the lower thread 41 wound on the thread bobbin 2. That is, the use of the elastic part 114 is only a matter of choice depending on the structure or the operation method of the LTERCP 112; and thus, even though each embodiment of the present invention illustrates the structure or the operation method using the elastic part 114 for easy explanation, there is no limitation or restriction regarding these in the present invention.

By the way, the aforementioned description, which mentioned that the position of the LCM 115 is directly or indirectly changed or the form of the LCM 115 is directly or indirectly altered due to the change in position of the LTERCP 112, refers to the following: that the change in position of the LTERCP 112 directly changes the position of the LCM 115 or alters the form of the LCM 115; and that the change in position of the LTERCP 112 causes the rotation of the thread bobbin 2 to be delivered to the LCM 115, and thus, indirectly changes or rotates the position of the LCM 115 or alters the form of the LCM 115.

Figure 8A:
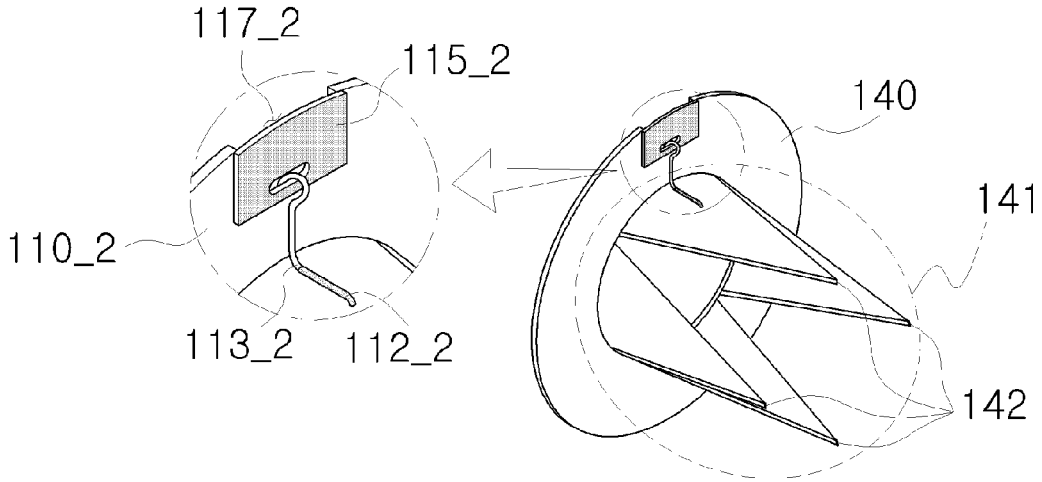
FIG. 8A illustrates an embodiment of the structure, in which both the LTERCP and the light control means (abbreviated as LCM in the present invention) are installed on the RTPL, showing that the position of the LCM changes due to the change of the LTERCP's position.
Figure 8B:
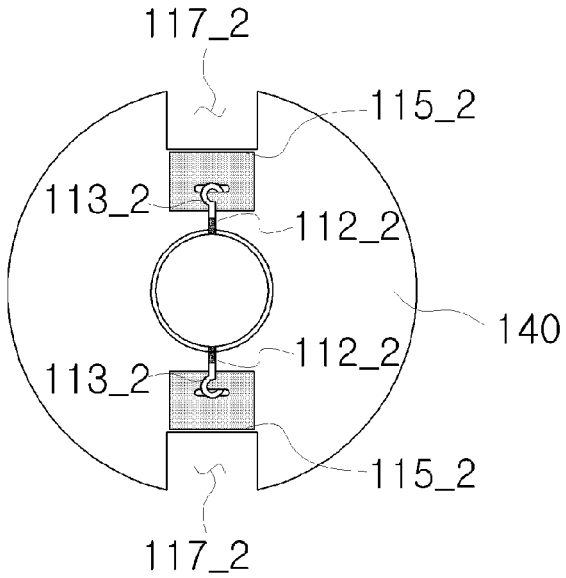
FIG. 8B illustrates a different embodiment of the structure, in which two LTERCPs and multiple LCMs are installed on the RTPL, for detecting both the LTRER and the LTBB simultaneously.
Figure 8C:
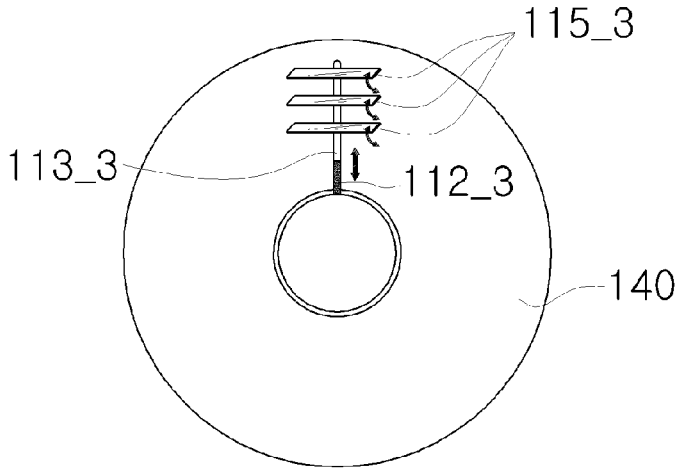
FIG. 8C illustrates a different embodiment of the structure, in which both the LTERCP and the LCM are installed on the RTPL, showing that the LCM's form changes due to the change of the LTERCP's position.
Figure 9A:
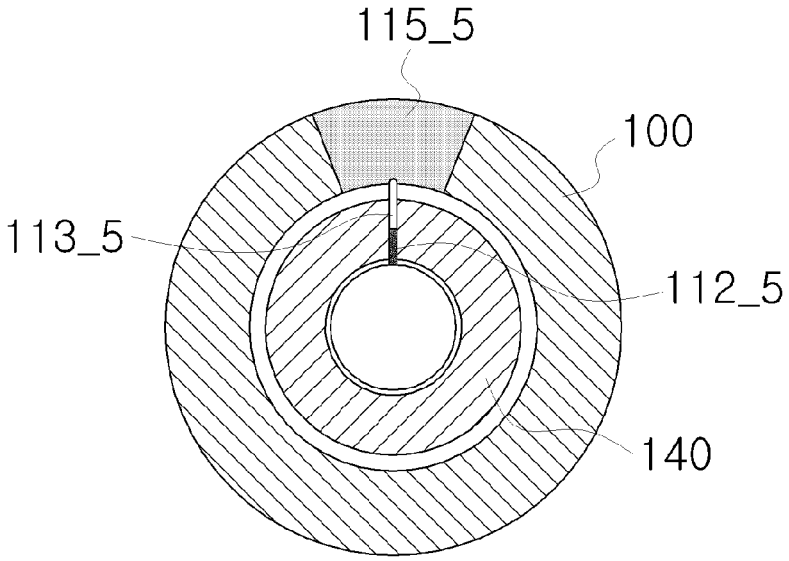
FIGS. 9A-9B illustrate some embodiments of the structures, in which the LTERCP and the LCM are distributed onto the RTPL and the fixed plate (abbreviated as FXPL in the present invention), showing that the change of the LTERCP's position invokes the change or rotation of the LCM's position due to the rotation of the thread bobbin.
Figure 9B:
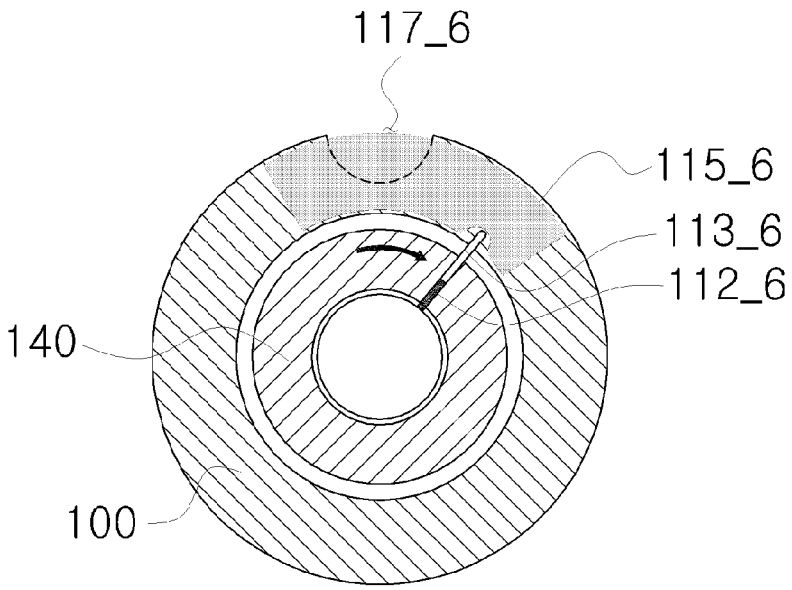
Figure 9C:
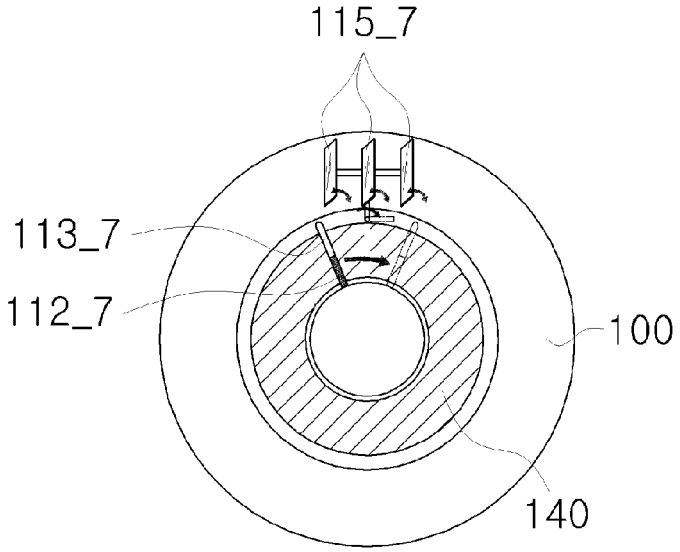
FIG. 9C illustrates a different embodiment of the structure, in which the LTERCP and the LCM are distributed onto the RTPL and the FXPL, showing that the change of the LTERCP's position invokes the change of the LCM's form due to the rotation of the thread bobbin.

For example, there are some embodiments of the structures in which the change in position of the LTERCP 112 invokes one of the following actions: directly changes the position of the LCM 115 as illustrated in FIGS. 7A-7C and FIGS. 8A-8B; directly alters the form of the LCM 115 as illustrated in FIG. 8C; indirectly changes or rotates the position of the LCM 115 as illustrated in FIGS. 9A-9B; and indirectly alters the form of the LCM 115 as illustrated in FIG. 9C. In addition, in FIG. 9B, there are some embodiments of the following structures: the change in position of the LTERCP 112 causes either the LCP to rotate with the thread bobbin 2 or the LCP to not rotate due to being separated from the thread bobbin 2; the change in position of the LTERCP 112 restrains LCP from rotating.

FIG. 8A is a perspective side view showing an embodiment of the structure of the RTPL 140, in which the LTERCP 112_2, the LCM 115_2, and the empty section—all of which compose the LCU 110_2—are installed. In FIG. 8A, different from FIG. 6A, the empty section 117_2 that is used as the light passing means is implemented on the RTPL 140; but, the separate elastic material such as the spring 114 is not illustrated. Here, since the empty section 117_2 formed on the RTPL 140 is one type of LCM, this RTPL 140 can carry out the role of the LCP implemented with two LCMs 115_2, 117_2. Here, the empty section 117_2 is not limited or restricted to a specific shape or size, but can be made in various forms. For example, it can be formed in the same shape and size as the hole formed on the back side of the EH 1*a* or the hole formed on top of the BC 4.

Like in the aforementioned embodiment, the LTERCP 112_2 is connected to the connecting part 113_2.

According to FIG. 8A, the connecting part 113_2 is connected to the LCM 115_2 with a link. Therefore, if the lower thread of the ending region 18 wound on the contact groove 19 of the bobbin core 10 is still left, then the LTERCP 112_2 receives the effect of the PMF which pushes the LTERCP 112_2 downwards; and thus, the connecting part 113_2 moves downward; and as a result, the connecting part 113_2 changes and maintains the position of the LCM 115_2 downwards.

Reversely, if the lower thread of the ending region 18 is unwound, then the force that pushed the LTERCP 112_2 downwards disappears; and thus, the connecting part 113_2 moves upwards due to the restoration of its elasticity; and as a result, the connecting part 113_2 changes the position of the LCM 115_2 upwards.

That is, depending on whether the lower thread of the ending region 18 is unwound, the position of the LTERCP 112_2 is changed due to the effect of the PMF; and the LTERCP 112_2 carries out a physical movement of directly changing the position of the LCM 115_2; and as a result, the function of the LCM 115_2 becomes activated or inactivated. By the way, the function of the empty section 117_2, which is another type of LCM, is reversely inactivated or activated in this process.

As mentioned above, the present invention has a structure in which the function of the LCM 115_2 becomes activated or inactivated as the position of the LCM 115_2 is changed due to the change in position of the LTERCP 112_2 depending on whether the lower thread of the ending region 18 is unwound; therefore, the present invention can easily solve the problem that was difficult to solve in previous inventions. For example, in the case of using the structure in which a RFP (i.e. a light reflecting means) is used as the LCM 115_2, and the RFP 115_2 is moved upwards to the place where the hole formed on top of the BC 4 is located when the lower thread of the ending region 18 is unwound; it is only necessary that both the LEU 120 and the LRU 151 are simply installed to point towards the hole formed on top of the BC 4. That is, there is no need to install each of the LEU 120 and the LRU 161 to be extremely accurately aligned at a very steep angle, through the hole formed on top of the BC 4, towards the reflective tape that is attached on the small bobbin core 10, which is located at the bobbin spindle 23 inside of the BC 4.

That is, it is much more useful in terms of easiness and accuracy making both the LEU 120 and the LRU 151 simply point towards the hole formed on top of the BC 4, which is fixed without moving, rather than making both the LEU 120 and the LRU 151 be extremely accurately aligned towards the small bobbin core 10, which rotates and shakes up and down or left to right at the bobbin spindle 23 inside the BC 4.

In addition to the aforementioned embodiment, where the RFP (i.e. light reflecting means) is used as the LCM 115_2, the present invention can also use the BLP (i.e. light blocking means), the PNP (i.e. light penetrating means) or the empty section (i.e. light passing means) as the LCM 115_2; wherein the LEU 120 and the LRU 151 can be installed in different ways. That is, there is a structure that makes the LEU 120 and the LRU 151 be installed in a way so that the LEU 120 and the LRU 151 face one another; and makes the location of the BLP 115_2, PNP 115_2, or the empty section 117_2 move upwards to be able to block, penetrate, or pass the light of the LEU 120. Specifically, if the PHP 115_2 (i.e. light emitting means) is used, then there is no need to even install the LEU 120.

Besides these merits, the present invention also removes the problems related to sticking a reflective tape or a bar code tape to the small cylindrical bobbin core 10. That is, by simply using the RTPL 140 or the FXPL that is attached with a RFP 115_2 or a bar code 115_2 as the LCP, it becomes unnecessary to stick the reflective tape or the bar code tape to each bobbin core 10 one by one; and therefore, it can minimize production costs.

FIG. 8B shows another embodiment of the structure in which the LCM 115_2, which is installed on the RTPL 140, changes in position. In this structure, two LTERCPs 112_2 as well as two of each the LCMs 115_2 and empty sections 117_2 are installed on the RTPL 140. FIG. 8B illustrates the case in which the LCM 115_2 is positioned at the bottom, while FIG. 8A shows it positioned at the top.

As shown in FIG. 8B, in the case that the PHP 115_2 is used as the LCM, if the PHP 115_2 moves downwards in position and hides behind the RTPL 140's side wall that carries out the role of the BLP, then its function becomes inactivated and thus cannot emit light outside; reversely, if the PHP 115_2 moves upwards in position and appears at the location of the empty section 117_2 that is located at the top of the RTPL 140, then its function becomes activated and thus can emit light outside. In the case of FIG. 8B, the structure of the RTPL 140, which carries out the role of the LCP, is implemented with a total of 6 LCMs, which are two of each of the PHPs 115_2, the BLPs (i.e. the side wall of the RTPL), and the empty sections 117_2.

In the case that the BLP 115_2 is used as the LCM, if the position of the BLP 115_2 moves downwards then the function of the BLP 115_2 is inactivated, and thus, the light illuminated from the external LEU 120 is transferred in the opposite direction through the empty section 117_2; reversely, if the position of the BLP 115_2 is moved upwards then the function of the BLP 115_2 is activated, and thus the light is blocked and not transferred outside.

In the case that the RFP 115_2 is used as the LCM, if the position of the RFP 115_2 moves downwards then the function of the RFP 115_2 is inactivated, and thus, the light illuminated from the external LEU 120 is unable to be reflected outside; reversely, if the position of the RFP 115_2 is moved upwards then the function of the RFP 115_2 is activated, and thus the light is reflected and transferred outside through the empty section 117_2.

In each of the aforementioned cases, the PNP which penetrates light can be installed in place of the empty section 117_2 on the top of the RTPL 140.

Also, in the case that the RFP is at the location of the empty section 117_2 on the top of the RTPL 140 and the BLP 115_2 is used as the LCM, if the position of the BLP 115_2 moves downwards, then the function of the RFP is activated, and thus the light illuminated from the external LEU 120 is reflected and transferred outside; reversely, if the position of the BLP 115_2 moves upwards and becomes positioned in front of the RFP, then the function of the BLP 115_2 is activated, and thus the light becomes blocked and not transferred outside.

In this way, one LCP can be implemented with various LCMs, and the functions of each of the LCMs can be alternately activated due to the change in position of the LTERCP 112_2 depending on whether the lower thread of the ending region 18 is unwound.

By the way, in the case that the RTPL 140 is installed with the LCM 115_2, the function of which is activated or inactivated due to the change in position of the LTERCP 112_2, not only the situation of the LTRER is detected but the situation of the LTBB is also detected concurrently.

In FIG. 8B, in the case that two LCMs 115_2, as well as all the areas between two empty sections 117_2, are installed with green polarizing RFPs that only reflect green wavelength, a method of indirectly detecting the situation of the LTRER can be realized by detecting whether the RTPL 140 rotates.

In this case, if the lower thread of the ending region 18 is still left, then the green polarizing RFP 115_2 becomes positioned below the empty section 117_2, and thus, the function of the RFP 115_2 will be inactivated and the green light will not be reflected from there even when the light is illuminated there; while the green polarizing RFP, which is installed in the areas between two empty sections 117_2, will be activated and the green light will be reflected from there when light is illuminated there. Therefore, if the RTPL 140 is rotating, then the green wavelength light repetitively alternates being reflected and not reflected; and as a result, it is easy to detect whether the RTPL 140 rotates. If the RTPL 140 is maintained in a stopped state, then the reflected green wavelength light does not repetitively alternate being reflected or not reflected. That is, if the green polarizing RFP installed in the area between the empty sections 117_2 is in an activated state (that is, it is positioned where it can reflect light illuminated from outside), then the state of reflecting green wavelength light is maintained; while, if the green polarizing RFP installed in the area between the empty sections 117_2 is in an inactivated state (that is, it is positioned where it cannot reflect light illuminated from outside), then the state of being unable to reflect green wavelength light is maintained.

Therefore, the CNU 150 can easily determine whether the RTPL 140 is rotating by analyzing whether the output signal of the LRU 151 changes. Here, the change in the output signal of the LRU 151 that occurs due to the high speed movement of the EH 1*a* or the sewing machine needle is not taken into account to keep the explanation simple.

By the way, if the lower thread of the ending region 18 is unwound, then the green polarizing RFP 115_2 becomes positioned at the empty section 117_2; and thus, the function of the green polarizing RFP 115_2 becomes activated; and therefore, all the areas of the RTPL 140 are able to reflect the green wavelength light; so, even though the RTPL 140 rotates, its rotation cannot be detected. That is, the situation of the LTRER occurs.

However, it is difficult to differentiate whether the RTPL 140 does not rotate because the rotation of the thread bobbin 2 has stopped due to the lower thread not being used or because the situation of the LTRER has occurred. Therefore, in order for the CNU 150 to differentiate the two situations, various methods that detect the rotation of the SMM that will be explained in the second embodiment need to be used. For example, if the CNU 150 is able to detect the rotation of the SMM but unable to detect the rotation of the RTPL 140 (that is, the CNU 150 determines that the state of reflecting the green wavelength light is maintained by analyzing the detection signal output from the LRU 151), then the CNU 150 determines that the situation of the LTRER has occurred. By the way, in the case that the situation of the LTBB occurs, the above mentioned phenomenon also occurs; and therefore, the CNU 150 determines that at least one of the situations of the LTRER and the LTBB has occurred, and then outputs the result to the user.

In FIG. 8B, in the case that two LCMs 115_2 are installed with red polarizing RFPs that only reflect red wavelength, and all the areas between two empty sections 117_2 are installed with green polarizing RFP, then a method, which can concurrently determine as well as differentiate whether the lower thread has reached the ending region and whether the thread bobbin 2 rotates, can be realized.

That is, if the lower thread of the ending region 18 is unwound, then the red polarizing RFP 115_2 becomes positioned at the empty section 117_2; thus, the function of the red polarizing RFP 115_2 can be activated; and thus, the green wavelength light and the red wavelength light are alternately reflected outside due to the rotation of the RTPL 140; and so, the CNU 150 can concurrently determine as well as differentiate whether the lower thread has reached the ending region and the thread bobbin 2 rotates (that is, the RTPL 140 rotates). Therefore, as mentioned above, in the case that the various methods, which detect the rotation of the SMM as explained in the second embodiment of the present invention, are used, the CNU 150 can differentiate and determine which one of the situations between LTRER and the LTBB has occurred, and outputs the result to the user. In other words, every time the RTPL 140 rotates, if the LRU 151 outputs a detection signal of receiving red wavelength light, then the CNU 150 determines that the situation of the LTRER has occurred; and if the CNU 150 determines that the rotation of the SMM is detected but the rotation of the RTPL 140 is not detected by analyzing the detection signal output from the LRU 151, then the CNU 150 determines that the situation of the LTBB has occurred. Here, the change in the output signal of the LRU 151 that occurs due to the high speed movement of the EH 1*a* or the sewing machine needle is not taken into account to keep the explanation simple.

The methods, which concurrently determine as well as differentiate whether the lower thread has reached the ending region and whether the thread bobbin 2 rotates, include a method that uses only one LRU 151 and analyzes its different electrical signals output depending on the wavelength of the received light; and a method that uses two LRUs 151 that each responds to different wavelengths.

The aforementioned embodiment shows the RTPL 140, which carries out the role of the LCP, that is implemented with a configuration having two different RFPs (green, red) that perform the same function but different in the wavelength or frequency of the light transferred out. In the aforementioned embodiment, the RTPL 140 can also be implemented with another configuration having two different RFPs that perform the same function with same wavelength or frequency but different in amount or brightness of light.

The aforementioned embodiments about the RFP can also be applied to the PHP, the BLP, and the PNP. Also, the aforementioned methods that the CNU 150 uses to determine whether the lower thread has reached the ending region and whether the thread bobbin 2 rotates, and the methods that the CNU 150 uses to determine the situations of the LTRER and the LTBB by using additional various methods of determining the rotation of the SMM that will be explained in the second embodiment, can all be applied to all embodiments in the present invention; thus, detailed explanations for these will not be repeated.

By the way, even though the above descriptions can be realized with the use of only one LCM 115_2 installed on the RTPL 140, if more LCMs 115_2 are installed, the period of activation and inactivation of the functions of those LCMs 115_2 become shorter during the rotation of the RTPL 140; and thus, the rotation of the thread bobbin 2 can be detected faster. Since it is up to the user to decide how many LCM 115_2 to use, there is no limitation or restriction regarding this in the present invention.

By the way, although not shown, the position of the LCM 115_2 can also change from left to right instead of up and down. To mention a brief example, the LCM can be made as a sliding wall structure, which acts as a window curtain, and installed on the upper part of the RTPL 140; this sliding wall can be made with a cylindrical piece, the outer line and inner line of which are round, so that when pushed left or right, it can move around the outer side of the RTPL 140. The sliding wall structure used as an example here resembles the sliding wall window installed on the FXPL 100 that is shown in FIG. 9B, which will be explained later. However, a difference is that this is installed on the RTPL 140 and its movement is a little different. When the user combines the thread bobbin 2 and the RTPL 140, if the user pushes the position of the sliding wall all the way to the left (i.e. the closed position), then the elastic substance installed at the left end of the window frame is pushed down and the sliding wall gets caught by a wedge (or lock or knob) of the window frame. If the lower thread of the ending region 18 is still left, then the LTERCP 112 and the connecting part 113, which are installed on the RTPL 140, are maintained in a pushed down state; but, if the lower thread of the ending region 18 is unwound, then the elasticity of the connecting part 113 is restored and the connecting part 113 moves upwards; thus the connecting part 113 touches and releases the wedge (or lock or knob) of the window frame; and thus, the elastic substance installed at the left end of the window frame gains a restoring force; and as a result, the sliding wall moves back to its original position (i.e. the open position).

Through this type of operation, the function of the LCM 115, which is made as a sliding wall structure, is activated or inactivated depending on its left or right movement. In addition, in the case that the sliding wall's area is divided into two pieces, the left one is installed with the BLP and the right one is installed with the RFP; then depending on whether the lower thread of the ending region 18 is unwound, each of the functions of the two types of LCMs 115 can be alternately activated due to the change in position of the LTERCP 112. For example, depending on whether the lower thread of the ending region is unwound, the blocking function and the reflecting function of the two LCMs 115 can be alternately activated.

As described above, the LCM can be made of, painted with, or taped with a certain material or substance, and can be made as a type of plate. Since the LCM can also be made of other various materials and with other various forms, there is no limitation or restriction to its material, structure, shape, form, or characteristic in the present invention.

FIG. 8C is an embodiment that shows the method of altering the form of the LCM 115_3 due to the change in position of the LTERCP 112_3. That is, it shows an example of the LCM 115_3, which is installed on the RTPL 140, changing in direction rather than in position.

In FIG. 8C, in the case that the RFP is used as the LCM 115_3, the RFP 115_3 is made as slices rather than being made as one body, much like the horizontal blinds used like window curtains; thus, depending on the vertical movement of the connecting part 113_3, the blinds are turned in a direction so that they can be closed or open (that is, the wide surface of the RFP 115_3 can be turned in a horizontal direction or a vertical direction); thus the RFP 115_3 can reflect or not reflect light outside.

Although not shown, the RFP can be made as a structure comprising several prism panels or prism crystals; and depending on the vertical movement of the connecting part 113_3, the direction of the prism panels or the prism crystals can be changed vertically so that they can reflect or not reflect light outside.

The aforementioned embodiments about the RFP can also be applied to the PHP, the BLP, and the PNP.

In the aforementioned embodiments, only one or two of each of the LTERCP 112,112_2,112_3 and the connecting part 113,113_2,113_3 are shown; but since these can be made up of various numbers in the technical spirit of the present invention, there is no limitation or restriction regarding this in the present invention.

In addition, since the LCM 115,115_2,115_3 installed on the RTPL 140 can be formed with varying positions, numbers, shapes, sizes, structures, materials, and operation methods, there is no limitation or restriction regarding these in the present invention.

And, the aforementioned embodiments showed some structures, in which the connecting part 113,113_2,113_3 only moves vertically; but other various structures, in which it can move in other directions (for example, front to back), can also be implemented. These various structures just need to be able to change the position or alter the form of the LCM 115,115_2,115_3 due to the movement of the connecting part 113,113_2,113_3. Here, as mentioned above, the connecting part 113,113_2, 113_3 is connected to the LTERCP 112, 112_2,112_3, and both can be made as one body.

So far, in FIGS. 7A-7C and FIGS. 8A-8C, the embodiments of structures in which the LTERCP 112,112_2,112_3 and the LCM 115,115_2,115_3 are all installed in only the RTPL 140 has been discussed.

By the way, if this RTPL 140 is made as a form that is attached with or formed on the lower thread winding-spool (bobbin core 10,11, auxiliary bobbin core 21, bobbin 12*a*, 12*b*), or the side board 13—all of which compose the thread bobbin 2—then consequently, a structure in which the LTERCP 112 and LCM 115 are all installed on the thread bobbin 2 is implemented. In this case, because the structure and the operation method of the thread bobbin 2 are very similar to that of the aforementioned RTPL 140, the explanation is omitted.

As previously mentioned, the LTERCP 112 and the LCM 115 can be distributed onto the RTPL 140 and the FXPL 100, or all installed on just the FXPL 100, or distributed onto the FXPL 100, RTPL 140 and thread bobbin 2.

FIGS. 9A-9C and FIG. 10 illustrate some embodiments of the structures in which the LTERCP 112 and the LCM 115 are distributed onto the RTPL 140 and the FXPL 100; FIG. 12 shows an embodiment of the structure in which the LTERCP 112 and the LCM 115 are all installed on the FXPL 100; FIG. 13 shows an embodiment of the structure in which the LTERP 112 and the LCM 115 are distributed onto the FXPL 100, RTPL 140 and thread bobbin 2.

The FXPL 100 refers to a plate that does not rotate with the thread bobbin 2 because it is not directly combined with the thread bobbin 2. The FXPL 100 can be made as a separate plate and inserted inside the BC 4 or the IH 1*b*, or made as one body with the BC 4 or IH 1*b* when each one is produced; thus, since the installation and configuration of the FXPL 100 can be made as various forms, there is no limitation or restriction regarding these in the present invention; and therefore the FXPL 100 includes all of these forms.

FIGS. 9A-9C illustrate some embodiments of the structures in which the LTERCP 112 and the LCM 115 are distributed onto the RTPL 140 and the FXPL 100; and the position or the form of the LCM 115 can be indirectly changed due to the change in position of the LTERCP 112.

FIG. 9A illustrates an embodiment of the structure in which the LTERCP 112_5 and the connecting part 113_5 of the LCU 110 are installed on the RTPL 140, and the LCM 115_2 is installed on the FXPL 100. That is, in this case, the FXPL 100 carries out the role of the LCP of the LCU 110. FIGS. 9B-9C illustrate other embodiments of the detailed structure in which the LCM 115_5 is installed on the FXPL 100.

As shown in FIG. 9A, the connecting part 113_5 installed on the RTPL 14 physically contacts the LCM 115_5 installed on the FXPL 100; and the connecting part 113_5 changes the position or the form of the LCM 115_5. That is, as the lower thread wound on the thread bobbin 2 is unwound, the connecting part 113_5 (including the LTERCP 112) moves towards the FXPL 100; and thus, after it contacts the LCM 115_5 installed on the FXPL 100, the rotation of the RTPL 140 affects the LCM 115_5. In other words, in this type of structure, the change in position of the LTERCP 112 causes the RTPL 140 to attach (or link) to the LCM 115; and thus the LTERCP 112 indirectly causes the position or the form of the LCM 115 to be rotated or changed due to the rotation of the thread bobbin 2 (that is, the RTPL 140).

FIG. 9B illustrates an embodiment of the structure in which the LCM 115_6 installed on the FXPL 100 operates as a sliding wall that acts like a window curtain. Here, the empty section 117_6 plays the role of the window glass, and the BLP 115_6 plays the role of the sliding wall. The empty section 117_6 is fixed at a specific region of the FXPL 100, while the BLP 115_6 is made with cylindrical pieces, the outer line and inner line of which are round, so that when pushed left or right, it can move around the outer side of the FXPL 100. That is, if the BLP 115_6 is positioned at the left (if rotated counterclockwise), then the empty section 117_6 opens; reversely, if the BLP 115_6 is positioned at the right (if rotated clockwise), then the empty section 117_6 closes. In this case, two different LCMs (i.e. the empty section 117_6 and the BLP 115_6) are installed on the FXPL 100 which carries out the role of the LCP. In addition, there is a groove formed at the bottom portion of the BLP 115_6 which is contacted by the connecting part 113_6.

The LTERCP 112_6 and the connecting part 113_6, both of which are installed on the RTPL 140, maintain their state after having moved upwards due to the restored elasticity when the lower thread of the ending region 18 is unwound or when the thread bobbin 2 has not yet combined with the RTPL 140. In this case, the end portion of the connecting part 113_6 contacts the groove formed at the bottom portion of the BLP 115_6. In FIG. 9B, before the user combines the thread bobbin 2 and the RTPL 140, the user needs to turn the RTPL 140 to the left so that the BLP 115_6 is positioned on the left and so the light can pass through the empty section 117_6 of the FXPL. Afterwards, the user has to combine the thread bobbin 2 and the RTPL 140.

If the thread bobbin 2, on which the lower thread of the ending region 18 is still wound, is combined with the RTPL 140, then the connecting part 113_6 of the RTPL 140 is pushed down by the lower thread; and thus, its end portion is unable to contact the groove formed at the bottom portion of the BLP 115_6. In this case, even though the RTPL 140 rotates, it is unable to push (rotate) the BLP 115_6 towards the right (clockwise).

If the lower thread of the ending region 18 is unwound, then the end portion of the connecting part 113_6 is able to contact the groove formed at the bottom portion of the BLP 115_6. In this case, if the RTPL 140 rotates, then it is able to push (rotate) the BLP 115_6 towards the right; and thus the BLP 115_6 covers the empty section 117_6; and as a result, the light from the LEU 120 becomes blocked and unable to pass through. In this embodiment of the structure, the RTPL 140 is made so that it rotates towards the right as the lower thread is unwound. Of course, the RTPL 140 can also be made so that it rotates towards the left as the lower thread is unwound.

By the way, the aforementioned descriptions about FIG. 9B have introduced a structure in which the BLP 115_6 can only move (rotate) towards the right (clockwise) within a space to cover the empty section 117_6 and cannot move beyond that space; that is, a structure in which the BLP 115_6 can only move within the limited space. However, in the case of a structure in which the BLP 115_6 can rotate completely in all spaces of the FXPL 100, when the lower thread of the ending region 18 is unwound, then the form of operation of this structure is completely different than the above mentioned descriptions.

That is, in the case of a structure in which the BLP 115_6 is made to only move in the limited space, if the lower thread of the ending region 18 is unwound, then the BLP 115_6 covers the empty section 117_6 once and stays in the same position afterwards; thus, even though the lower thread is still continued to be used and the RTPL 140 keeps rotating, no more light can pass through outside. Therefore, if the light is blocked rather than passed through outside, the CNU 150 determines that the situation of the LTRER has occurred.

By contrast, in the case of a structure in which the BLP 115_6 is made to completely rotate in all spaces of the FXPL 100, if the lower thread of the ending region 18 is still left, then the BLP 115_6 does not cover the empty section 117_6 so the light continues to pass through outside; but, in the case that the lower thread of the ending region 18 is unwound, as the lower thread is being used, the RTPL 140 rotates; and thus, every time the RTPL 140 rotates, the BLP 115_6 covers the empty section 117_6 once, repeatedly. Therefore, if the state of the light being blocked and passed through repetitively alternates, then the CNU 150 determines that the situation of the LTRER has occurred. Of course, the complete opposite operation can be implemented as well.

The aforementioned BLP 115_6 can also utilize a form in which its size is enlarged and divided into left and right halves, which are equipped with various LCMs that perform different functions that are alternately carried out. For example, if the BLP 115_6 is equipped on the left half and the RFP is equipped on the right half, then the functions of blocking light and reflecting light are alternately carried out.

In this case, the FXPL 100, which carries out the role of the LCP, is installed with three different LCMs: the empty section 117_6, the RFP, and the BLP.

Although the aforementioned BLP 115_6 is made as a form that is small in size and installed above the FXPL 100, it can also be made as the same size as the FXPL 100 and located behind the FXPL 100. This is like a form in which there are two thin FXPLs positioned in front and behind; wherein the empty section 117_6 is formed on the front FXPL 100, and the back FXPL, which rotates by only a certain angle when the lower thread of the ending region 18 is unwound, carries out the role of the BLP 115_6. Here, a portion of the area of the BLP 115_6 is installed with the PNP so that the light, which passed through the empty section 117_6 of the front FXPL 100 depending on whether the lower thread has reached its ending, can be blocked or penetrated by the BLP 115_6 (i.e. the back FXPL 100). If needed, the FXPL 100 formed with the empty section 117_6 and the FXPL 100 that carries out the role of the BLP 115_6, can be switched in position. In this case, it can be a structure that is composed of two FXPLs 100, which carry out the role of the LCP, and one RTPL 140 that rotates insides one among the two FXPLs 100.

Figure 11:
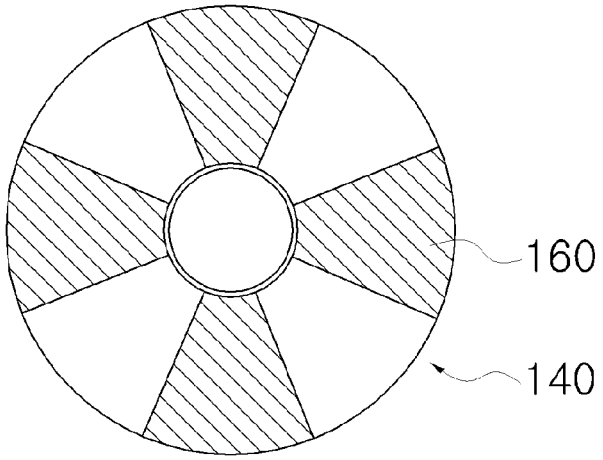
FIG. 11 illustrates an embodiment of the rotation detection mark (abbreviated as RDM in the present invention) which is printed on the side of the RTPL and used to easily detect the rotation of the thread bobbin.

In addition, the aforementioned BLP 115_6 is made as a form that is the same size as the FXPL 100 but can completely rotate like the RTPL 140. In this case, it is a structure that comprises the outer big RTPL 140 and the inner small RTPL 140; wherein both the outer big and the inner small RTPLs 140 carry out the role of the LCP. On the outer big RTPL 140, a RDM, such as the one shown in FIG. 11, is installed and a groove is formed on the bottom area. Therefore, if the connecting part 113_6 contacts the groove of the outer big RTPL 140 due to the change in position of the LTERCP 112_6 that is installed on the inner small RTPL 140, then the outer big RTPL 140 rotates with the inner small RTPL 140; reversely, if the connecting part 113_6 does not contact the groove of the outer big RTPL 140, then the outer big RTPL 140 does not rotate even though the inner small RTPL 140 rotates. The connecting part 113_6 can be made as a form that can move either towards the groove or in the opposite direction of the groove when the lower thread of the ending region 18 is unwound. According to this, the function of the LCM 115 will be carried out in a complete opposite manner.

By the way, as described above, in the case that the structure comprising the outer big RTPL 140 and the inner small RTPL 140 is used, if the center portion of the outer big RTPL 140 can be positioned at the vicinity of the BSH 22 of the inner small RTPL 140, then the situation of the LTRER and the rotation of the thread bobbin 2 can be detected concurrently.

If the lower thread of the ending region 18 is still left, then the LTERCP 112_6 installed on the inner small RTPL 140 is pushed down, and therefore, pushes down the center portion of the outer big RTPL 140; thus, the two come to closely contact one another so that as the small inner RTPL 140 rotates due to the rotation of the thread bobbin 2, the outer big RTPL 140 rotates as well. Therefore, the function of the LCM 115_6, which is installed on the outer big RTPL 140 that carries out the role of the LCP, repetitively alternates between the state of activation and inactivation; and thus, the rotation of the LCP is easily detected by the CNU 150. If the lower thread of the ending region 18 is unwound, then the LTERCP 112_6 installed on the inner small RTPL 140 moves upwards due to its elasticity; thus, the LTERCP 112_6 is no longer able to push down the center portion of the outer big RTPL 140; and thus, the outer big RTPL 140 separates from the thread bobbin 2; and as a result, the outer big RTPL 140 no longer rotates despite the continuous rotation of the inner small RTPL 140 due to the rotation of the thread bobbin 2 during the usage of the lower thread. Therefore, the function of the LCM 115_6, installed on the outer big RTPL 140, does not repetitively alternate between the state of activation or inactivation; and thus, the CNU 150 can easily determine the situation of the LTRER since the rotation of the LCP is not detected. That is, if the CNU 150 determines that the SMM is rotating, through various methods of detecting the rotation of the SMM as explained in the second embodiment of the present invention, but the CNU 150 determines that the LCP is not rotating because the function of the LCM 115_6 is not repetitively alternating between the state of activation and inactivation, then the CNU 150 determines that at least one of the situations of the LTRER and the LTBB has occurred; and the CNU 150 outputs the result to the user. By the way, in the situation that the function of the LCM 115_6 is not repetitively alternating between the state of activation and inactivation, if the thread bobbin 2 is still rotating (that is, if the lower thread is still being used), then it means that the situation of the LTRER has occurred; if the thread bobbin 2 is not rotating (that is, the lower thread is no longer being used), then it means that the situation of the LTBB has occurred. By the way, it is preferred that the outer big RTPL 140 obtains a certain rotation load by magnetism or friction so that the outer big RTPL 140 can be attracted to the side wall of the BC 4 or the IH 1*b*. This will be described later.

By the way, a structure that restrains the RTPL 140 from rotating by means of friction, which is generated as the connecting part 113_6 contacts some part of the FXPL 100, the BC 4, or the IH 1*b* when the LTERCP 112_6 installed on the RTPL 140 changes in position due to the unwinding of the lower thread of the ending region 18, can be made. Of course, a structure that restrains the thread bobbin 2 from rotating can be made as well. Made as these various structures, the rotation of the LCP can be restrained due to the effect of friction generated by the connecting part 113_6; and thus, can also obtain the effect of preventing the rotation of the LCP that may occur due to just the shaking of the BC 4 or the IH 1*b* during the operation of the SMM.

FIG. 9C illustrates an embodiment of the different structure of the LCM 115_7, in which, the BLP is used as the LCM 115_7 and is made as several slices, much like vertical blinds that act as a window curtain, instead of being made as one body.

In this case, if the lower thread of the ending region 18 is unwound, then the connecting part 113_7 is moved upwards and contacts a knob (or handle) that can rotate the blinds of the BLP 115_7; thus, due to the rotation of the RTPL 140, the form of the LCM 115_7 changes (that is, the BLP's large surface is rotated 90 degrees); and thus, the light that had been blocked by the BLP 115_7 passes through.

The aforementioned embodiments about the BLP can also be applied to the PHP, the RFP, and the PNP.

Although FIGS. 9A-9C illustrate the RTPL 140 to be made as a small size and positioned in the center area of the FXPL 100, the RTPL 140 can also be made as the same size as the FXPL 100. That is, the center portion of the RTPL 140 protrudes, through the center hole of the FXPL 100, so that it can contact with the side wall of the BC 4 or the IH 1*b*, but the rest of its portions are made as big as the FXPL 100 and positioned behind the FXPL 100. The main goal for making the RTPL 140 in this form is to install a RDM on its side in order to be easily detected the rotation of the thread bobbin 2 like shown in FIG. 11.

Figure 10:
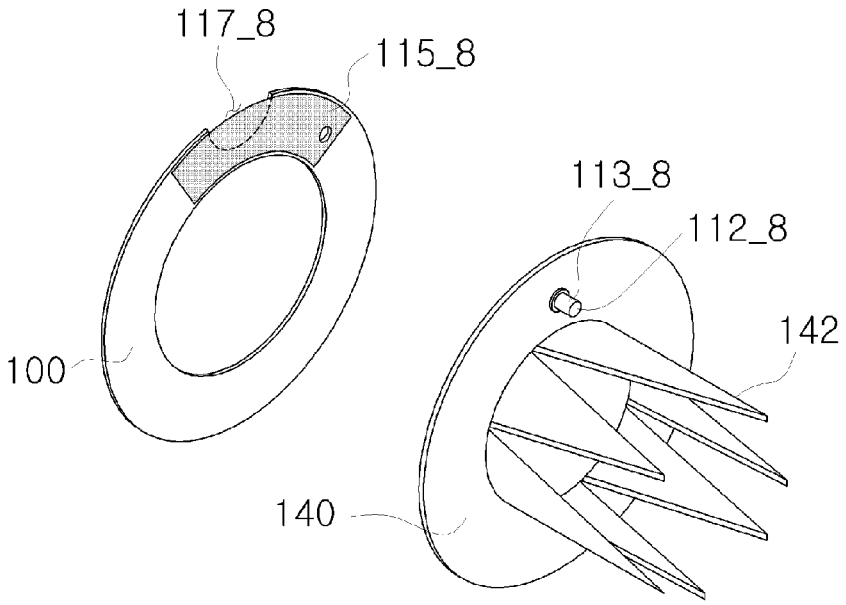
FIG. 10 illustrates an embodiment of the structure, in which the LCMs are installed on both of the RTPL and the FXPL, for detecting the LTRER and the thread bobbin's rotation as well as the LTBB.

FIG. 10 illustrates an embodiment of the structure in which the FXPL 100, formed as shown in FIG. 9B, is positioned in front and the RTPL 140, installed with the LTERCP 112_8

(including the connecting part 113_8), is positioned in the back; and the size of the RTPL 140 is made as the same size as the FXPL 100; and its front side facing the FXPL 100 is installed with the RFP and the BLP, both of which are formed as the RDM 160 shown in FIG. 11. However, in this case, for convenience sake, the BLP 115_8 installed on the FXPL 100 is designated as a structure that can only move within the limited space.

In this type of structure, both the FXPL 100 and the RTPL 140 carry out the role of the LCP.

If the lower thread of the ending region 18 is still left, the BLP 115_8 installed on the FXPL 100 does not cover the empty section 117_8 installed on the FXPL 100; thus, the light coming in from outside can pass through the empty section 117_8 and illuminate the RFP and the BLP, both of which are installed on the RTPL 140; and thus, a situation in which both functions of the RFP and the BLP can be activated is created. That is, if the lower thread is used, then the thread bobbin 2 rotates (that is, the RTPL 140 also rotates); thus, the positions of the RFP and the BLP installed on the RTPL 140 also rotate; and thus, the light is reflected outside through the empty section 117_8 and blocked alternately; and therefore, the rotation of the RTPL 140 can be easily detected. From the standpoint of the RFP, this means that its function repetitively alternates between the state of activation or inactivation.

If the lower thread of the ending region 18 is unwound, then the connecting part 113_8 moves towards the FXPL 100; thus, the BLP 115_8, installed on the FXPL 100, moves to the right due to the rotation of the RTPL 140; and thus, the BLP 115_8 covers the empty section 117_8 and blocks the light coming in from outside; as a result, the function of the RFP, installed on the RTPL 140, is inactivated. Therefore, since there is no light being reflected outside, the rotation of the RTPL 140 is not detected; consequently, it is easy to detect whether the situation of the LTRER has occurred.

In other words, the activation of the function of the RFP installed on the RTPL 140 in the aforementioned embodiment only occurs when two following conditions are satisfied: the first condition is that the BLP 115_8 installed on the FXPL 100 must not cover the empty section 117_8; the second condition is that the RFP must be positioned where the empty section 117_8 is (that is, where the light is illuminated) during the rotation of the RTPL 140. And the inactivation of the RFP's function occurs when at least one of two following conditions are satisfied: the first condition is that the BLP 115_8 must cover the empty section 117_8; the second condition is that the RFP must not be positioned where the empty section 117_8 is (that is, where the light is illuminated) during the rotation of the RTPL 140.

As mentioned in the aforementioned embodiments, if the various detection methods of determining the rotation of the SMM explained in the later-discussed second embodiment of the present invention are additionally used, it becomes easy to detect whether the lower thread has been broken.

By the way, as previously mentioned, in the various embodiments of FIG. 9B, a structure in which several RTPLs 140 carry out the role of the LCP can be used. In addition, each RTPL 140 can be made as various sizes different from the embodiment shown in FIG. 9B.

For example, in FIG. 10, if the RTPL 140 formed as shown in FIG. 8B is used instead of the FXPL 100 positioned in the front, then it can be a structure in which two big RTPLs are positioned in the front and the back. In this case, the back RTPL directly combines with the thread bobbin 2 to rotate together, while the front RTPL combines with the back RTPL to rotate together. At this point, through the physical movement of the connecting part 113_8 (including the LTERCP 112_8) of the back RTPL, the front RTPL can carry out the role of the BLP 115_2, which can also move up and down; while the back RTPL is installed with the RDM 160 shown in FIG. 11, and carries out the role of supporting the detection of the rotation of the thread bobbin 2. Of course, the front and black RTPL can also take on opposite roles.

FIG. 11 illustrates an embodiment of the RDM 160 that is drawn on one side surface of the RTPL 140 to make it easy to detect the rotation of the thread bobbin 2.

As the RDM 160 is simply a mark that makes it easy to detect the rotation of the thread bobbin 2, and has been installed on the side surface of the thread bobbin 2 or the RTPL 140 in a fixed pattern of alternately laying out the LCMs 115 having different functions or having same functions but different in the wavelength, frequency, amount, or brightness of light. The PHP, the RFP, the BLP, the PNP, or the empty section can be used as this LCM 115. Since the LCM 115 used for the RDM 160 can formed varying in position, number, shape, and size, there is no limitation or restriction regarding these in the present invention.

FIG. 12 illustrates an embodiment of the structure in which the LTERCP 112_9 and the LCM 115_9 are both installed on the FXPL 100 only.

The structure, in which the LTERCP 112_9 and the LCM 115_9 are both installed on the FXPL 100, is similar to the structure in which both are installed on the RTPL 140; and thus, the position or the form of the LCM 115_9 can be changed directly due to the change in position of the LTERCP 112_9. However, a difference is that, unlike the RTPL 140, the FXPL 100 does not rotate with the thread bobbin 2; and thus, during all the rotation of the thread bobbin 2, the lower thread of the ending region 18 has to continuously make contact with the LTERCP 112_9 installed on the FXPL 100; therefore, the lower thread of the ending region 18 can be somewhat damaged or worn out.

When this type of structure is used, as the pressure that produces the PMF of the LTERCP 112_9 is exerted due to the resisting power of the lower thread when the thread bobbin 2 contacts the FXPL 100; thus, the position of the LTERCP 112_9 is changed; as a result, the position or the form of the LCM 115_9 is changed, or maintains the change in position or form. In addition, in the case that the lower thread of the ending region 18 is unwound, the resisting power of the lower thread disappears resulting in the loss of PMF that changes or maintains the position or form of the LCM 115_9.

By the way, the resisting power of the lower thread mentioned in the aforementioned embodiments is the same as the PBP mentioned in the second embodiment of the present invention. However, since the first embodiment of the present invention explains with a focus on the PMF of the LTERCP, the term 'resisting power of the lower thread' is used instead of the PBP to explain the effect of the PMF, for the sake of convenience.

FIG. 13 illustrates an embodiment of the structure in which the LTERCP 112_10 and the LCM 115_10 are distributed onto the FXPL 100 and the thread bobbin 2.

For example, the LTERCP 112_10 is installed on the thread bobbin 2 and the LCM 115_10 is installed on the FXPL 100. This type is very similar to the structure and the operation method illustrated in FIG. 9B except the only difference that the LTERCP 112_10 is installed on the thread bobbin 2 instead of the RTPL 140; and thus, a detailed explanation is omitted.

In addition, there is also a structure, in which the LTERCP 112_10 is installed on the thread bobbin 2 and the LCM 115_10 is installed on the RTPL 140, which is the same as the structure illustrated in FIG. 13. However, the only difference is that the RTPL 140 is used instead of the FXPL 100.

However, there is a big difference in the operation method between the structure in which the LCM 115_10 is installed on the FXPL 100 and the structure in which the LCM 115_10 is installed on the RTPL 140.

That is, in case of using the FXPL 100, when the lower thread of the ending region 18 is unwound, the position of the LTERCP 112_10 installed on the thread bobbin 2 changes; thus, the LTERCP 112_10 becomes combined with the rotating thread bobbin 2; however, since the FXPL 100 basically does not rotate with the thread bobbin 2, the LCM 115_10 only partially rotates once and then remains in the halted state; as a result, it becomes easy to detect whether the lower thread has reached the ending region.

On the other hand, in case of using the RTPL 140, since the LCM installed on the RTPL 140 basically rotates with the thread bobbin 2; thus, depending on whether the lower thread of the ending region 18 is unwound, the LCM 115_10 installed on the RTPL 140 rotates or does not rotate with the thread bobbin 2 due to the change in position of the LTERCP 112_10 installed on the thread bobbin 2. Therefore, it can be detected whether the lower thread has reached the ending region or not depending on whether the LCM 115_10 installed on the RTPL 140 rotates or not.

Although not illustrated, there is a structure in which the LTERCP 112 is installed on the thread bobbin 2 and the LCM 115 is installed on the FXPL 100, and the RDM 160 like shown in FIG. 11 is installed on the lower thread winding-spool or the side board 13—both of which compose the thread bobbin 2. This type is the structure mentioned in the embodiment illustrated in FIG. 10, in which the thread bobbin 2 installed with the LTERCP 112 is used instead of the RTPL 140; and because the operation method is very similar to that of FIG. 10, a detailed explanation is omitted.

In addition, although not illustrated, there is a structure in which the LTERCP 112 (including the connecting part 113) is installed on the FXPL 100, and the RDM 160 like shown in FIG. 11 is installed on the lower thread winding-spool or the side board 13—both of which compose the thread bobbin 2.

In addition, although not illustrated, the RTPL 140 can be made as a form that is small in size as illustrated in FIGS. 9A-9C and located at the center area of the FXPL 100, and the RDM 160 like shown in FIG. 11, is installed on the lower thread winding-spool or the side board 13—both of which compose the thread bobbin 2. This structure is one that additionally uses the thread bobbin 2 installed with RDM 160 as illustrated in FIGS. 9A-9C.

Although not illustrated, through other various structures in which the LTERCP 112 and the LCM 115 are distributed onto the RTPL 140, the FXPL 100, and the thread bobbin 2, the situations of the LTRER and the LTBB can be detected concurrently.

Although various embodiments of the structure and operation method of the LTERDA have been described until now, it can be easily understood that there can be even more various other structures within the technical spirit of the present invention.

As described above, since the RTPL 140 and the FXPL 100 can be formed with varying numbers, shapes, sizes, structures, materials, characteristics, and operation methods within the technical spirit of the present invention, there is no limitation or restriction regarding these in the present invention.

In addition, since the LTERCP 112, the connecting part 113, the elastic part 114, and the LCM 115 can be formed with varying numbers, shapes, sizes, structures, materials, positions, characteristics, and operation methods within the technical spirit of the present invention, there is no limitation or restriction regarding these in the present invention.

Figure 14:
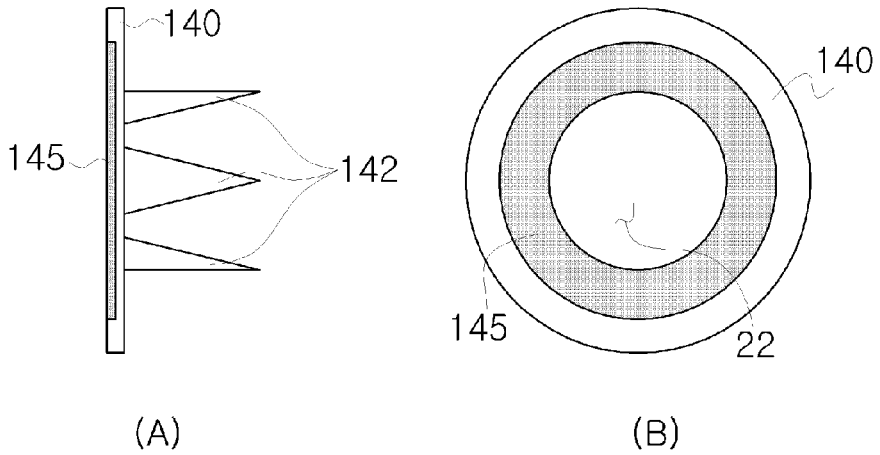
FIG. 14 illustrates the side view (A) and the rear view (B) of the RTPL showing the magnet or magnetic substance installed on the side surface of the RTPL.

FIG. 14 illustrates an embodiment of the structure in which a RLGM equipped with a magnet that is implemented on a portion of the RTPL.

In FIG. 14, (A) illustrates the side view of the RTPL 140 showing the magnet or magnetic substance 145 installed on the side surface of the RTPL 140_2, and (B) illustrates the rear view of the RTPL 140 showing the magnet or magnetic substance 145 installed on the side surface of the RTPL 140.

That is, the magnet or magnetic substance 145 is attached to one side surface of the RTPL 140, and carries out the functions that allow the RTPL 140 combined with the thread bobbin 2 to be easily inserted into the IH 1*b* or the BC 4, both of which are made of metallic substance; and that allow the RTPL 140 to stably operate as it is attracted to the wall of the BC 4 or the IH 1*b* without falling off.

Since the magnet or magnetic substance 145 attached to the side surface of the RTPL 140 can be formed with varying positions, shapes, sizes, structures, materials, and numbers in the technical spirit of the present invention, there is no limitation or restriction regarding these in the present invention.

As described above, in the case that the magnet or magnetic substance 145 is installed on the side surface of the RTPL 14, the RTPL 140 combined with the thread bobbin 2 can rotate as it is attracted to the metallic substance BC 4 or IH 1*b* by magnetism; and thus, the effect of maintaining an even tension of the lower thread can be obtained during the unwinding of the lower thread.

That is, in the case that the magnet or magnetic substance is installed on the side surface of the RTPL 140, a magnetic field is produced by the magnet or magnetic substance, and this magnetic field generates a force of reciprocal attraction or friction between the RTPL 140 and one out of among the BC 4, the IH 1*b* and the metallic substance located inside the BC 4 and the IH 1*b*; and thus, a rotation load, which is a certain power that resists the rotation of the thread bobbin 2, is generated, and thus can maintain an even tension during the unwinding of the lower thread wound on the thread bobbin.

Even if the RLGM, which is equipped with the magnet or magnetic substance that is installed on the side surface of the thread bobbin 2 instead of the RTPL 140, is used, the same rotation load can be obtained as described above.

In addition, if the RLGM, which is equipped with the magnet or magnetic substance that is installed on at least one out of among the BC 4, IH 1*b* and a material attached to the inside of the BC 4 and the IH 1*b* and is equipped with a metal or metallic substance that is easily attracted to the magnetism is installed on the RTPL 140 or the thread bobbin 2, is used, the same rotation load can be obtained as described above.

In the various embodiments described until now, if the position of the LTERCP 112 is changed due to the effect of the PMF, then the position of the LCM 115 is changed or rotated, or the form of the LCM 115 is altered, or the LCP rotates with the thread bobbin, or the LCP does not rotate due to separation from the thread bobbin, or the rotating of the LCP is resisted; and as a result, the function of the LCM 115 is activated or inactivated.

Wherein the various embodiments described above, the LRU 151 receives the light that has been transferred outside or blocked depending on the activation or inactivation of the function of the LCM 115, and outputs a detection signal; and the CNU 150 analyzes the detection signal of the LRU 151 and determines whether the lower thread has reached the ending region and outputs the result to the user. In addition, the CNU 150 can also determine whether the thread bobbin 2 or the RTPL 140 rotates by analyzing whether the function of the LCM 115, installed on the thread bobbin 2 or the RTPL 140, repetitively alternates between the state of activation or inactivation. Additionally, the CNU 150 determines whether the situations of the LTRER and the LTBB have occurred through using the various methods of determining the rotation of the SMM explained in the later-discussed second embodiment of the present invention, and outputs the result to the user.

The following will explain the LTERDA of the second embodiment of the present invention.

The second embodiment of the present invention uses a LCU, in which the function of the LCM does not repetitively alternate between the state of activation and inactivation when the lower thread of the ending region 18 is unwound, even though the lower thread wound on the thread bobbin 2 is still left and continues to be used; wherein, it is used that at least one of two physical changes—the change in the PBP of the lower thread wound on the thread bobbin 2 and the change in the power of the lower thread winding the thread bobbin 2—that will occur depending on whether the lower thread of the ending region 18 is unwound.

In addition, the LRU 151, which receives the light transferred outside by the LCU and outputs a detection signal, is used.

Additionally, in the second embodiment of the present invention, either a method that indirectly detects the rotation of SMM through the detection signal output from the LRU 151 or a MRSU 300 that directly detects the rotation of SMM and outputs a detection signal, is used.

And, the CNU 150 determines whether the LCU rotates by analyzing the detection signal output from the LRU 151, and determines whether the SMM rotates by analyzing the detection signal that notifies the rotation of the SMM; and through these determinations, the CNU 150 determines whether the lower thread has reached the ending region, and outputs the result to the user. That is, if the rotation of the SMM is determined but the rotation of the LCP is not, then the CNU 150 determines that the lower thread wound on the thread bobbin 2 has reached the ending region 18.

By the way, in the second embodiment of the present invention, the LCU may comprise one or more LTERCPs and one or more LCPs 180. The LCP 180 can be installed with a LCM 115 such as the RDM 160 illustrated in FIG. 11. However, since whether to use the LTERCP is a choice, the LTERCP does not necessarily have to be used in the second embodiment of the present invention. Instead, various forms of LTERCP can be used, and an adhesive substance can be used additionally.

Figure 15:
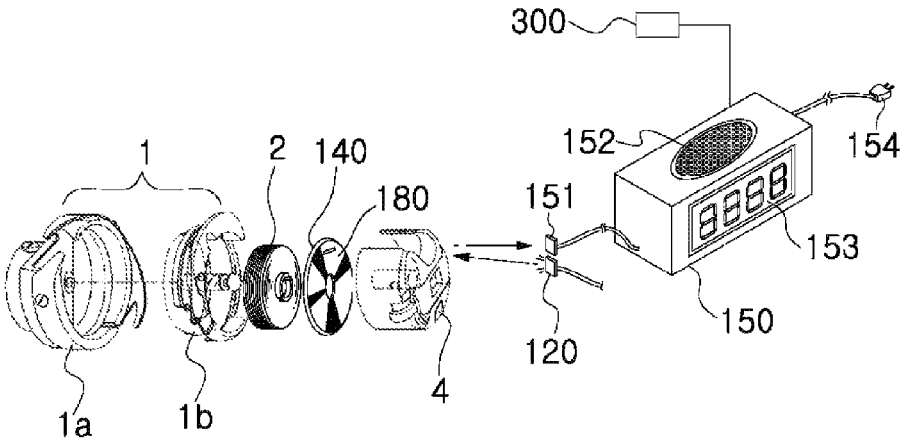
FIG. 15 illustrates an exploded perspective view showing the operating environment of the LTERDA based on the second embodiment of the present invention; wherein a motor rotation sensing unit (abbreviated as MRSU in the present invention) is added.

FIG. 15 illustrates the overall operating environment that includes the LTERDA of the second embodiment of the present invention.

According to FIG. 15, the difference between the overall operating environment of the second embodiment and that of the first embodiment illustrated in FIG. 1, is that the MRSU 300 is additionally used. Of course, here, instead of using the MRSU 300, a method that indirectly detects the rotation of the SMM by using the existing LRU 151, which detects whether the function of the LCM 115 installed on the LCP is activated or inactivated, can be used.

In addition, all descriptions about the thread bobbin 2, the BC 4, the RTPL 140, the IH 1*b*, the EH 1*a*, the LEU 120, the LRU 151, the CNU 150, and the LCP illustrated in FIG. 1 can also be applied in the second embodiment as well.

Also, all descriptions about the various parts that compose the thread bobbin 2 and various types of the thread bobbins 2, shown in FIGS. 2-3, can also be applied in the second embodiment.

And, all descriptions about the lower thread ending region 18, the contact groove 19, the BC 4, the RTPL 140, the FXPL 100, the parking part 141, the BCISS 142, the PPIS 30, the LTERCP 112, the LCP, the LCM 115, the RDM 160, and the magnet or magnetic substance 145, shown in FIGS. 4, 5, 6A-6C, 7A-7C, 8A-8C, 11 and 14, can also be applied in the second embodiment.

Therefore, to avoid repeating examples and explanations, duplicate descriptions about these matters are omitted.

By the way, as for the method detecting the rotation of the SMM, either a method that directly detects the rotation of the SMM by using various MRSU 300 or a method that indirectly detects the rotation of the SMM through using the LRU 151, which can detect whether the function of the LCM 115 implemented on the LCP is activated or inactivated, can be used.

Although, for the sake of convenience in describing the patent claims, the MRSU 300 is defined as being included in the CNU 150 in the present invention, FIG. 15 illustrates the MRSU 300 as an independent and separate unit from the CNU 150 in order to take into account the independent function of the MRSU 300, and for the sake of convenience in explaining the MRSU 300.

In other words, the description that the CNU 150 comprises the MRSU 300 is used as just a logical meaning for the sake of convenience in describing the patent claims; in actuality, the MRSU 300 and the CNU 150 can be produced as independent units. However, the MRSU 300 is equipped with a certain sensor and only outputs a detection signal, while the CNU 150 makes the final determination on whether the SMM rotates.

The biggest difference between the first and second embodiments of the present invention is that the structure and the function of the LTERCP are different. That is, in the second embodiment, the same form of LTERCP discussed in the first embodiment can be used, and a different form of LTERCP can also be used. In addition, since whether to use the LTERCP is a choice in the second embodiment, it does not necessarily have to be used. Furthermore, in the second embodiment, the lower thread ending region and the position of the contact groove can be same as or different from what was discussed in the first embodiment. This will be explained later on.

Figure 16:
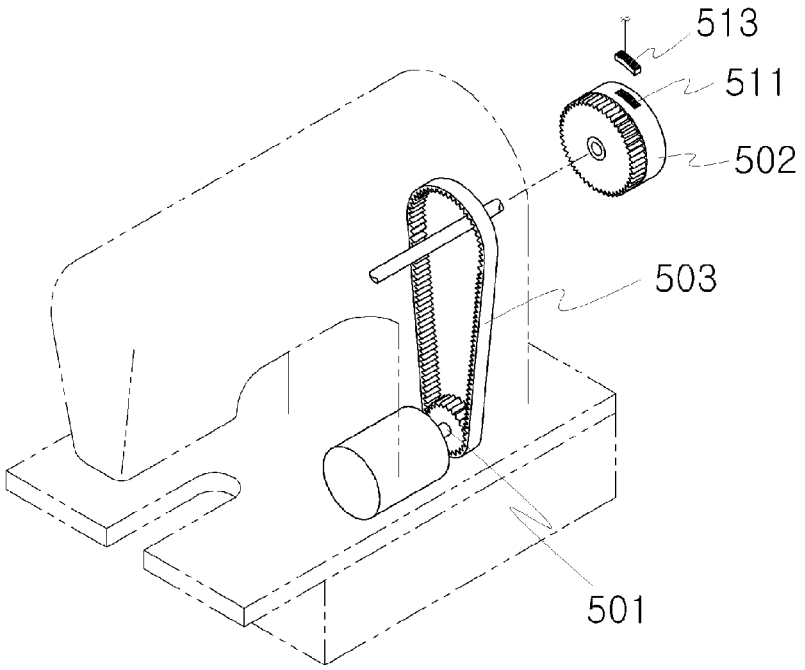
FIG. 16 illustrates an embodiment of the MRSU using a magnetic sensor which directly detects the rotation of the SMM.

FIG. 16 illustrates a simple embodiment of the MRSU 300 using a magnetic sensor to directly detect the rotation of the SMM.

As for the MRSU 300 that directly detects the rotation of the SMM, one can be chosen out of several forms that use certain sensors to detect various equipments' motions such as a rotating motion, a reciprocating motion, and other motions in connection to the SMM's rotation. That is, since the MRSU 300 can be chosen from various forms such as a form using a magnetic sensor to directly detect the rotation of the SMM, a form using a separate LRU or a magnetic sensor to detect the reciprocating motion of the sewing machine needle, a form using a separate LRU or a magnetic sensor to detect the rotating or reciprocating motion of the EH 1*a*, and various other forms to detect various equipments' motions; there is no limitation or restriction regarding these in the present invention.

If the CNU 150 comprises the MRSU 300 that directly detects the rotation of the SMM, then it determines the rotation of the SMM by analyzing the detection signal output from the MRSU 300.

According to FIG. 16, the MRSU 300 comprises one or more magnet 511 that is installed on at least one of the places—the belt driving axle 501 of the SMM, the turning wheel 502 of the sewing machine, the drive belt 503 driving the belt driving axle 501 and the turning wheel 502; and a magnetic sensor 513 that outputs an electric signal that changes by a certain amount (i.e. level) of voltage or electric current depending on the magnetism of the magnet 511. Therefore, every time the SMM rotates, one or more magnet 511 passes by the magnetic sensor 513; thus, the magnetic sensor 513 outputs an electric signal repetitively alternating logically between high (for example, 5 Voltage) and low (for example, 0 Voltage) states. However, if the SMM stops and does not rotate, then the magnetic sensor 513 outputs an electric signal that maintains its logical high or low state. Since the magnetic sensor 513 can be chosen from various types of sensors such as a Hall Effect sensor, a GMR sensor (giant magneto resistive sensor), an AMR sensor, a reed switch and etc., there is no limitation or restriction regarding these in the present invention.

Although not illustrated, a separate LRU can be used and can be located at the side or back of the EH 1*a* that performs a rotating or reciprocating motion in connection to the rotation of the SMM; and the LRU receives the light repetitively alternating between being reflected and not reflected from the RFP installed on the EH 1*a* or from the outer wall itself of the EH 1*a*, and outputs a detection signal.

As described above, in the case that a separate LRU (or detection unit) is used to directly detect the rotation of the SMM, the CNU 150 can easily determine whether the light was blocked by the BLP 115 installed on the LCP, or by an outside factor like the EH 1*a*. That is, in the case that the CNU 150 determines that the light has been blocked by analyzing the detection signal output from the LRU 151; and if the CNU 150 also determines that the exterior wall of the EH 1*a* is not positioned above the LCP by analyzing the detection signal output from a separate LRU (or detection unit), then it determines that the light has been blocked by the BLP 115; and, in the opposite case, it determines that the light has been blocked by the EH 1*a*.

By the way, as described above, there are various methods that indirectly detect the rotation of the SMM through using an existing LRU 151 that detects whether the function of the LCM 115 installed on the LCP is activated or inactivated.

For example, there is a structure in which the LEU 120 and the LRU 151 are located at the back or the side of the EH 1*a* that performs a rotating or reciprocating motion in connection to the rotation of the SMM; and the LEU 120 illuminates light to the LCP that is stored inside the IH 1*b*. Here, the LCP can be installed on the RTPL 140 or the thread bobbin 2.

In this structure, the LCP can be alternately installed with a red polarizing light RFP and a green polarizing light RFP as a form of the RDP 160 illustrated in FIG. 11; wherein the red polarizing light RFP and the green polarizing light RFP reflect only red wavelength light and green wavelength light respectively. Although this is similar to what is illustrated in FIG. 8B, the difference is that each RFP is fixed rather than changing in position.

If the LCP rotates due to the rotation of the thread bobbin 2 during the usage of the lower thread, then the red polarizing light RFP and the green polarizing light RFP are alternately activated and so each reflects its wavelength of light that is transferred outside. Therefore, the CNU 150 is able to easily determine whether the LCP rotates by analyzing the detection signal output from the LRU 151.

In this process, every time the EH 1*a* rotates or moves back and forth due to the rotation of the SMM, the hole formed on the EH 1*a* and the exterior wall of the EH 1*a* alternately passes through or blocks the light. Therefore, the red wavelength light and the green wavelength light are transferred outside or blocked; thus, the CNU (15) can determine the rotation or reciprocal motion of the EH 1*a* by analyzing the detection signal output from the LRU 151.

In the aforementioned embodiment, a high brightness RFP and a low brightness RFP can be used instead of the red polarizing light RFP and the green polarizing light RFP. In addition, two different RFPs that reflect out the same wavelength of light but different in amount or brightness of light can also be used.

By the way, even in the case that the existing LRU 151 receives the light reflected from the exterior wall of the EH 1*a*, if the light reflected from the exterior wall of the EH 1*a* and the light reflected from the LCM 115 are different in the wavelength, amount or brightness, then the CNU 150 can easily and concurrently determine the rotations of both the LCP and the EH 1*a* by analyzing the detection signal output from only the LRU 151.

In the aforementioned embodiments, the PNP or the BLP can be used instead of the RFP, and because the LCM 115 can be made as various forms, there is no limitation or restriction regarding this in the present invention.

In summary, the EH 1*a*, which rotates or moves back and forth due to the rotation of the SMM, partially obstructs the light transferred to the LCU or the light transferred to the LRU 151 from the LCU, causing changes in the pattern of the light received by the LRU 151 every time the EH 1*a* rotates or moves back and forth; thus, the CNU 150 can determine the rotation of the SMM and also calculate the exact number of rotations and speed of rotation (that is, how many rotations in a given amount of time) of the SMM by analyzing the pattern of the detection signal output from the LRU 151.

By using a different method from the aforementioned embodiment, the rotation of the SMM can be indirectly detected through using the existing LRU 151. For example, there is a structure in which the LEU 120 and the LRU 151 are located near the BC 4, and the LEU 120 illuminates light to the LCP that is stored inside the BC 4. In this case, a sewing machine needle, which moves up and down due to the rotation of the SMM, partially obstructs the light transferred to the LCU or the light transferred to the LRU 151 from the LCU, causing changes in the pattern of the light received by the LRU 151 every time the sewing machine needle moves up and down; thus, the CNU 150 can determine the rotation of the SMM and also calculate the exact number of rotations and speed of rotation (that is, how many rotations in a given amount of time) of the SMM by analyzing the pattern of the detection signal output from the LRU 151.

In addition to the aforementioned embodiments, since various methods can be used to indirectly detect the rotation of the SMM using the existing LRU 151, there is no limitation or restriction regarding these in the present invention.

In addition, since various structures can be used including a structure that uses just one LRU 151 to output different electric signals depending on the wavelength, amount, or brightness of the received light; or a structure that uses two or more LRUs 151 that respond differently depending on the wavelength, amount, or brightness of the received light; there is no limitation or restriction regarding this in the present invention. Also, in the case that the PNP is used, the LEU 120 does not necessarily have to be used.

By the way, the CNU 150 can use the existing LRU 151 to differentiate whether the light was blocked by the BLP 115, or the EH 1*a*, or an outside factor like the sewing machine needle, through various analysis methods. For a simple example, there is a method to analyze the pattern cycle of the detection signal output from the LRU 151. That is, the BLP 115 moves or rotates at a lower speed; but, the EH 1*a* or the sewing machine needle rotates or moves at a high speed of more than 1,000 times per minute; and thus, the time intervals that the light is blocked or not blocked by the BLP 115 and the EH 1*a* are very different; therefore, the pattern cycles of the detection signals output from the LRU 151 are also very different.

Here, the CNU 150 can utilize the method in which the rotation of the SMM is indirectly detected by analyzing the change in pattern of the detection signal output from the LRU 151 due to the movement of the EH 1*a* or the sewing machine needle as described above; or reversely, the CNU 150 can utilize the method, which eliminates the change that occurs in the pattern of the detection signal output from the LRU 151 due to the movement of the EH 1*a* or the sewing machine needle by using a filter or capacitor, and uses a separate MRSU 300 to directly detect the rotation of the SMM; whichever method used is up to choice of the user. The filter or capacitor that eliminates the change in pattern of the detection signal output from the LRU 151 can be installed on the LRU 151 or the CNU 150.

By the way, in the second embodiment, the FXPL 100 which is installed with the LCM 115 such as the empty section or the PNP can also be used, and since the function of the LCM 115 is the same as described in the first embodiment; therefore, the following embodiments will not describe about this again.

Figure 17:
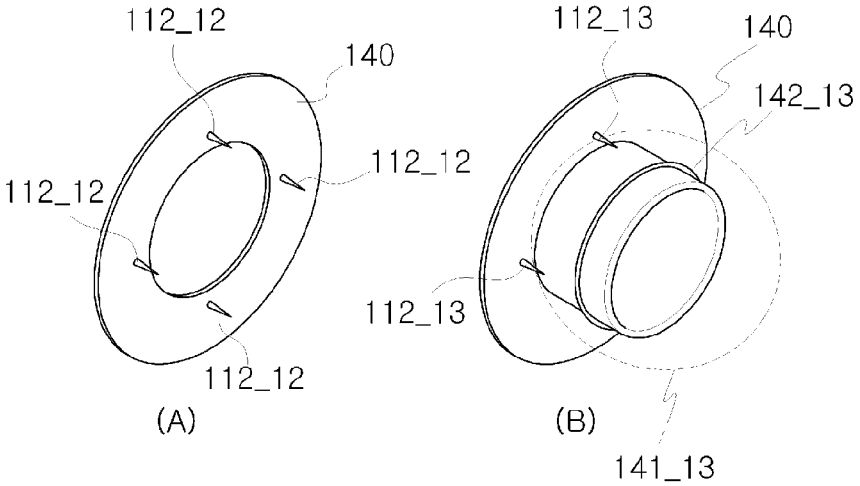
FIG. 17 illustrates some embodiments of the structures, in which the LTERCPs are installed on the RTPL, showing that the position of the LCM rotates due to the effect of the PBP of the LTERCPs.

FIG. 17 illustrates some embodiments of the structure of the RTPL 140 that is installed with the LTERCP 112_12 on one side surface and the LCP 180 on the other side surface; wherein the LCP 180 is installed with the LCM. Of course, even though not illustrated, the LCP 180 can be installed on the lower thread winding-spool or the side board 13 (both of which compose the thread bobbin 2) and the RTPL 140. That is, the LCP can be distributed between the RTPL 140 and the thread bobbin 2. Since the embodiments about this have already been described in various ways in the first embodiment of the present invention, it will not be described again in the second embodiment.

The embodiments of FIG. 17 illustrate some simple structures in which, depending on the change in the PBP of the lower thread wound on the thread bobbin 2, the LTERCP 112_12 that is installed on the RTPL 140 can be attached to or be separated from the side surface of the thread bobbin 2; and as a result, the function of the LCM 115 becomes activated or inactivated. Here, the change in the PBP of the lower thread refers to the phenomenon in which the PBP of the lower thread wound on the thread bobbin 2 changes depending on the unwinding of the lower thread of the ending region 18.

That is, in the case that the lower thread of the ending region 18 is still left, the PBP of the lower thread is strengthened so that the LTERCP 112_12 can be sustained as attached to the side surface of the lower thread of the thread bobbin 2, and thus the RTPL 140 rotates with the rotation of the thread bobbin 2; but in the case that the lower thread of the ending region 18 is unwound, a situation occurs in which the PBP of the lower thread is lost (released) so that the LTERCP 112_12,112_13 is separated from the side surface of the thread bobbin 2 (that is, the attached state is dissolved), and thus the RTPL 140 no longer rotates even though the thread bobbin 2 continues to rotate due to the usage of the lower thread. Here, the RTPL 140 can be made to obtain a rotation load by friction or magnetism to resist its rotation, and this can be applied in the same way to all the embodiments of the present invention.

Here, the separation of the LTERCP 112_12,112_13 from the side surface of the thread bobbin 2 includes all cases in which a state of exerting a force on each other is dissolved.

According to FIG. 17, a pin with a sharp end, which is made to be inserted slightly into the side surface of the lower thread of the ending region 18 wound on the thread bobbin 2, is installed on one side surface of the RTPL 140 with slightly protruding outwards. Here, the sharp pin carries out the role of the LTERCP 112_12,112_13. This RTPL 140 can be used instead of the RTPL 140 used in the first embodiment.

In FIG. 17, (A) illustrates the embodiment of the RTPL 140 without having the TBPP on its side surface, while (B) illustrates the embodiment of the RTPL 140 with the TBPP on its side surface. As described in the embodiments of FIGS. 6A-6C, the TBPP is formed to have a BCISS 142 that helps the user easily combine the thread bobbin 2 and the RTPL 140, and stably maintain the combined state. That is, by means of the BCISS 142, the LTERCP 112_12 formed on the side surface of the RTPL 140 can securely contact the lower thread of the ending region 18 wound on the thread bobbin 2. The BCISS 142_13 illustrated in FIG. 17 (B) can be made a structure in which a bump slightly protrudes out from the exterior surface of the cylindrical shape panel that is short in length and thin in thickness. By the way, the inner surface of the BSH (that is, the inner wall which borders the BSH 22) of the bobbin core 10 is formed to have the PPIS that has a shape corresponding to the shape of the BCISS 142_13. Therefore, as the cylindrical panel is easily inserted into the BSH 22 of the bobbin core 10, the exterior surface of the cylindrical panel and the inner surface of the BSH 22 are maintained stably contacted. The bump carries out the role of preventing the RTPL 140 and the bobbin core 10 from becoming dislodged. However, the RTPL 140 and the bobbin core 10 are combined in a loosely contacted state rather than a tightly attached state, and thus, can separate and rotate separately of each other.

The RTPL 140 illustrated in FIG. 17 (B) can be made as a structure that comprises an outer big RTPL and an inner small RTPL like mentioned in the embodiment of FIG. 9B. That is, the inner small RTPL is installed with the TBPP, and the outer big RTPL is installed with the LTERCP and the LCP 180. In this case, the structure of the BCISS of the TBPP can be made as a triangular shape with a certain amount of spacing as illustrated in FIG. 6A, or other suitable shapes and structures. Since the structures of the BCISS and PPIS can be made up of varying shapes, sizes, structures, numbers, and materials in the technical spirit of the present invention, the present invention is not limited or restricted to what is described in each embodiment of the present invention.

In the case that the lower thread of the ending region 18 is still left, the pin with the sharp end 112_12 is sustained as inserted into the side surface of the lower thread (for example, in between the overlapped lower thread, or in between the lower thread and the bobbin core 10); thus, the RTPL 140 can rotate with the thread bobbin 2; and thus, the LCM 115 installed on the side surface of the RTPL 140 also rotates; and therefore, the function of the LCM 115 repetitively alternates between the state of activation and inactivation.

In the case that the lower thread of the ending region 18 is unwound, the pin with the sharp end 112_12 can no longer be sustained in the state of being inserted into the side surface of the lower thread; thus, the RTPL 140 is separated from the thread bobbin 2 (that is, the state of contacting the lower thread of the thread bobbin is dissolved); thus, the RTPL 140 no longer rotates even though the thread bobbin 2 is still rotating during the usage of the lower thread; and thus, the LCM 115 also no longer rotates; and therefore, the function of the LCM 115 does not repetitively alternate between the state of activation and inactivation.

Therefore, the CNU 150 compares and analyzes the detection signal, which notifies of whether the SMM rotates, and the detection signal output from the LRU 151; and the CNU 150 determines that the SMM is still rotating but the LCP 180 no longer rotates because the function of the LCM 115 not repetitively alternating between the state of activation and inactivation; and then, the CNU 150 determines that the lower thread has reached the ending region, and outputs the result to the user.

However, in the case that the situation of the LTBB has occurred, the rotation of the LCP 180 is also not detected even though the SMM is still rotating.

In order to discern between the two situations described above, that is, the situation of the LTRER or the LTBB, it depends on whether the lower thread is continued being used. That is, in the case that the rotation of the SMM is detected but the rotation of the LCP 180 is not detected, if the lower thread of the thread bobbin 2 is continued being used and unwinding, then the situation of the LTRER has occurred; but if the lower thread is not unwinding, then the situation of the LTBB has occurred.

Although FIG. 17 illustrates a structure in which the LTERCP 112_12 is made as a shape of a pin with a sharp end without having elasticity and is slightly inserted into the side surface of the lower thread of the ending region 18; the LTERCP 112_12 can also be made as a shape with a serrated edge with elasticity so that it can attach to the side surface of the lower thread of the ending region 18; and thus, there is no limitation or restriction to its material, structure, shape, characteristics, and operation method in the present invention.

By the way, there is a method that can use the change in the PBP of the lower thread, in a different form from the embodiment of FIG. 17.

For example, as for the RTPL 140 illustrated in FIG. 17, instead of using the pin with the sharp end, the RTPL 140 is installed with an adhesive material that can stick the RTPL 140 to the side surface of the thread bobbin 2. In this case, the RTPL 140 adheres to any of the several layers of the lower thread wound around the ending region 18; and the RTPL 140 separates from the thread bobbin 2 when this portion of lower thread is almost all unwound; and thus, the RTPL 140 no longer rotates even though the thread bobbin 2 rotates during the usage of the lower thread. This type of structure uses the adhesive material, which is adhered on the side surface of the lower thread wound on the thread bobbin 2, as a means in order to utilize the change in the PBP. That is, in the case that the lower thread of the ending region 18 is still left, the PBP of the lower thread is strengthened, and thus the adhesiveness of the adhesive material can act (be fulfilled), and thus, the RTPL 140 can be maintained as adhered on the side surface of the lower thread wound on the thread bobbin 2; but, if the lower thread of the ending region 18 is unwound, then the PBP of the lower thread is lost (dissolved), and thus the adhesiveness of the adhesive material can no longer act (be fulfilled), and thus the RTPL 140 separates from the thread bobbin 2. This structure can also obtain similar effects if the side board 13, which composes the thread bobbin 2 and is made up of various materials, is used as the LCP 180. That is, an adhesive material is attached to the inner surface of the side board 13 and various LCMs 115 are installed on the outer surface of the side board 13 as illustrated in FIG. 11. In this case, the side board 13 plays the same role as the RTPL 140, so it is defined as the RTPL 140 in the present invention.

For a different method that uses the change in the PBP of the lower thread, there is a structure in which the LTERCP 112, which is illustrated in the first embodiment, can be used to attach or separate the RTPL 140, which carries out the role of the LCP 180, with the thread bobbin 2. This structure is similar to the structure which uses the PMF that makes the LTERCP 112, installed on the lower thread winding-spool, physically move. That is, in the case that the lower thread of the ending region 18 is still left, the LTERCP 112 is pushed down by the PBP of the lower thread, thus it obtains a power to attach the RTPL 140 to the thread bobbin 2, and thus the RTPL 140 can rotate with the thread bobbin 2; but if the lower thread of the ending region 18 is unwound, then the PBP of the lower thread is lost (dissolved), thus the LTERCP 112 can be freed from the pressure of the lower thread, and thus the RTPL 140 becomes separated from the thread bobbin 2 (that is, separated from the LTERCP 112), and therefore the RTPL 140 no longer rotates even though the thread bobbin 2 rotates.

As mentioned in the aforementioned embodiments, the LTERCP, which is used to utilize the change in the PBP of the lower thread wound on the thread bobbin 2, can be made in various ways. Therefore, since the LTERCP can be formed with varying structures, numbers, shapes, sizes, materials, characteristics, and operation methods in the technical spirit of the present invention, there is no limitation or restriction regarding these in all embodiments of the present invention.

There are various methods that use the change in the PBP, in different forms from the aforementioned embodiments, to detect the situation of the LTRER.

The following descriptions will explain the various embodiments that use the change in the winding power of the lower thread wound on the thread bobbin (i.e. the power that constricts or pushes the cylindrical body or the side plate of the lower thread winding-spool). Here, the change in the winding power of the lower thread wound the thread bobbin is the same as the change in the PBP. However, for the sake of convenience in explaining, a different expression is used.

Figure 18:
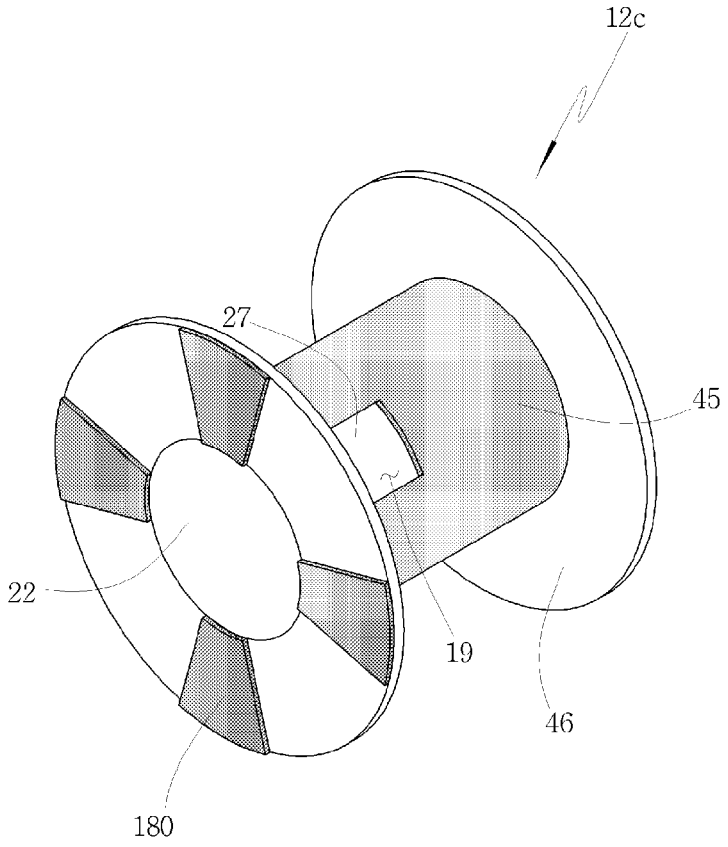
FIG. 18 shows an embodiment of bobbin having a tube, on a certain location of which one or more contact grooves are formed, and is made as a form surrounding at least a portion of the outer surface of the BSH.

FIG. 18 illustrates an embodiment of structure of a bobbin 12*c*, in which a cylindrical tube 45 is installed as a form surrounding the outer surface of the BSH (that is, the outer surface of the cylindrical body 27 that is formed with the BSH 22); wherein, the shape of the tube 45 is similar to the shape of the bobbin core, on which one or more contact groove 19 is formed on any location. Here, with the exception of the tube 45 having been added, the bobbin 12*c* is the same shape as the bobbin 12*a*,12*b* used in the first embodiment. By the way, the side plate 46 of the bobbin 12*c* is illustrated as being attached with the LCP 180. Here, the tube 45 can be made of metal, plastic, or various materials, and the lower thread is wound on the tube 45. In addition, since the tube 45 can be made as not only the cylindrical shape but also various structures and shapes including a shape of a bobbin in which the side plate 46 is fixed to a cylindrical body; therefore, there is no limitation or restriction to the shape, the size, the structure, and the material of the tube 45 in the present invention. By the way, the tube 45 can be made a form that surrounds the outer surface of the BSH of the lower thread winding-spool, which includes all forms such as the bobbin core and the bobbin.

When the lower thread is wound on the tube 45, the lower thread of the ending region 18 is positioned downwards towards the area below the bottom of the contact groove 19, and thus physically contacts the outer surface of the cylindrical body 27 (the outer surface of the BSH) that is located inside the hole of the tube 45. Therefore, depending on whether the lower thread of the ending region 18 is unwound, the winding power of the lower thread that constricts the outer surface of the cylindrical body 27 through the contact groove 19 is strengthened or weakened, and thus the cylindrical body 27 may rotate or may not rotate with the tube 45. That is, when the lower thread of the ending region 18 wound on the tube 45 is still left, the power of the lower thread winding the tube is strong, and thus the cylindrical body 27 rotates with the tube 45 as the lower thread is used; but, when the lower thread of the ending region 18 is unwound, the power of the lower thread winding the tube is weakened (loosened), and thus the tube 45 rotates as the lower thread is used but the cylindrical body 27 no longer rotates. Here, the cylindrical body can be made to obtain a rotation load by friction or magnetism to resist its rotation, and this will be applied in the same way in all of the following embodiments.

Since the cylindrical body described above can correspond to the aforementioned lower thread winding-spool, the following descriptions may refer to the cylindrical body as the lower thread-winding spool.

Thus, in the structure that uses the RTPL 140 installed with the TBPP 141 instead of using the lower thread winding-spool, that is, in the case that the tube is installed as a form that surrounds the outer wall of the TBPP 141 of the RTPL 140, the lower thread of the ending region 18 that is wound above the contact groove 19 of the tube, physically contacts the TBPP 141 that is located inside of the hole of the tube. Therefore, depending on whether the lower thread of the ending region 18 is unwound, the power of the lower thread winding the tube is strengthened or weakened, and thus the RTPL 140 can rotate or not rotate with the tube. In this case, the BCISS 142 of the TBPP 141 can be made as a structure shown in FIG. 17 (B) but without having a bump.

As mentioned several times already, in the aforementioned embodiment, the LCP 180 can also be installed on the lower thread winding-spool and the side board 13, both of which compose the thread bobbin 2, or the RTPL 140.

Therefore, in the case that the lower thread of the ending region 18 is still left, the LCP 180 rotates as the lower thread is used, and thus the function of the LCM 115 repetitively alternates between the state of activation and inactivation; but, in the case that the lower thread of the ending region 18 is unwound, the LCP 180 no longer rotates even though the lower thread is still being used, and thus the function of the LCM 115 does not repetitively alternate between the state of activation and inactivation. Therefore, the CNU 150 can easily detect the situation of the LTRER by comparing with the detection signal that notifies of whether the SMM rotates. This can be applied in the same way in the following embodiments.

The tube described above can be made as a structure that has slight elasticity to be easily oppressed or pushed down, and is installed as surrounding the outer surface of the BSH of the lower thread winding-spool. The contact groove 19 does not necessarily have to be formed on the tube. For example, a structure can be made in which if the lower thread of the ending region 18 wound on the tube is still left, the power of the lower thread winding the tube is strong, thus the tube is oppressed or pushed down and thus, for example, physically contacts the outer surface of the BSH of the lower thread winding-spool that is located inside the tube, and thus the lower thread winding-spool rotates as the lower thread is used; but, if the lower thread of the ending region 18 is unwound, then the power of the lower thread winding the tube is weakened (loosened), thus the elasticity of the tube is restored to its original state, and thus, for example, the tube becomes separated from the outer surface of the BSH of the lower thread winding-spool, and thus the lower thread winding-spool cannot rotate even though the lower thread is still being used.

By the way, in the structure that uses the RTPL 140 installed with the TBPP 141 instead of using the lower thread winding-spool, that is, in the case that the tube with slight elasticity is installed as surrounding the outer wall of the TBPP 141 of the RTPL 140, the RTPL 140 rotates with the tube or does not rotate depending on whether the lower thread of the ending region 18 is unwound.

The tubes described above can also be made as a form that surrounds only a portion of the outer surface of the BSH; wherein, the lower thread of the ending region 18 is wound on the tube. In this case, if the lower thread wound on the outside of the tube is still left, then the lower thread winding-spool or the RTPL 140 rotates with the tube as the lower thread is being used; but, if the lower thread of the ending region 18 wound on the tube is unwound after all the lower thread wound on the outside of the tube is unwound, then only the tube rotates but the lower thread winding-spool or the RTPL 140 does not rotates.

By the way, when the user puts the lower thread winding-spool or the RTPL 140 in the lower thread winding equipment and starts to wind the lower thread on the tube, the tube may falsely rotate; therefore, in order to prevent the false rotation of the tube, it needs to install or form a fitting part or slot (or groove or hole or aperture), which make the lower thread to fit, on the side surface of the lower thread winding-spool or the RTPL 140. In this case, the user must fit the lower thread at the fitting part or the slots before winding the lower thread, and take the lower thread out from the fitting part or the slots after winding all of the lower thread, and then use it.

Since the tubes described above can be formed as the lower thread winding spool (bobbin core 10,11, auxiliary bobbin core 21, and bobbin 12*a*,12*b*) and the lower thread is wound on it, the tube is defined as the lower thread winding-spool (bobbin core, auxiliary bobbin core, bobbin) in the present invention. Therefore, a type in which the lower thread wound on the tube is also defined as the thread bobbin. Thus like the aforementioned embodiments, one thread bobbin 2 can comprise several lower thread winding-spools (bobbin core, auxiliary bobbin core, bobbin) that are located on the outside and inside. By the way, in the case of the bobbin 12*a*,12*b* that has been made as the tube surrounding the outer surface of the BSH, one side plate can be made smaller than the other one, or not made at all; however, this is also defined as a bobbin in the present invention.

In addition, since the methods described above did not use the LTERCP that contact the lower thread of the ending region 18, the lower thread ending region 18 in this case means one or more layers out of any of the several layers of the lower thread wound on the lower thread winding-spool; wherein, its length corresponds to the residual amount of the ending region. That is, this does not only refer to the portion of lower thread wound around the vicinity of one ending region 20*b* of the lower thread winding-spool 10,11,21,12*a*, 12*b*. This applies to all the embodiments of the present invention.

Furthermore, since the contact groove 19 is made to expose (or draw outside) the lower thread of the ending region 18, it is not only used for the purpose of supporting the physical movement of the LTERCP 112. In addition, the contact groove 19 can be formed at any location such as the middle section or one end region 20*b* of the lower thread winding-spool. This applies to all the embodiments of the present invention.

Another method that uses the change in the winding power of the lower thread wound on the thread bobbin includes a structure in which the thread bobbin 2 or the RTPL 140, both of which carry out the role of the LCP 180, is installed with the LCM 115 as illustrated in FIG. 11, and is also installed with the RLGM as mentioned in the embodiment of FIG. 14; thus, a rotation load is applied to the RTPL 140 or the thread bobbin 2. In this structure, if a method, which adequately uses the balance between the winding power of the lower thread wound on the thread bobbin 2 and a rotation load generated by the RLGM, is used, then the situation of LTRER can be detected without using the LTERCP.

To explain in detail, in the case that the lower thread of the ending region 18 wound on the thread bobbin 2 is still left, the power of the lower thread winding the thread bobbin 2 is strong, thus the LCP 180 rotates as the lower thread is being used, and thus the function of the LCM 115 repetitively alternates between the state of activation and inactivation; but, in the case that the lower thread of the ending region 18 is unwound, the power of the lower thread winding the thread bobbin 2 becomes weakened (loosened) and thus, for example, is not able to overcome the rotation load that is added to the thread bobbin 2, thus the LCP 180 no longer rotates even though the lower thread is still being used, and thus the function of the LCM 115 does not repetitively alternate between the state of activation and inactivation. Therefore, the CNU 150 can easily detect the situation of the LTRER by comparing with the detection signal that notifies of whether the SMM rotates.

By the way, the rotation load can be generated by using various forms of a RLGM that generates rotation load by mechanical structure rather than the magnetism. That is, a form of generating a slight mechanical friction, by installing a mechanical part on or making a mechanical form on at least one out of among the bobbin spindle 23 of the bobbin case 4 and the inner surface of the BSH of each the lower thread winding-spool or the RTPL 140, can be used. In addition, another form of generating a slight mechanical friction, by increasing the width of the lower thread winding-spool to make the thread bobbin 2 rotate while slightly physically pressed between the bobbin case 4 and the IH 1*b*, can be used. Since various forms of applying the rotation load to the thread bobbin 2, by using various mechanical structure forms such as a spring, can be used, there is no limitation or restriction regarding these in all the embodiments of the present invention. That is, no matter what form of mechanical structure is used, if a situation is created—in which when the lower thread of the ending region 18 is unwound, the power of the lower thread winding the thread bobbin 2 is loosened and unable to overcome the rotation load that is applied to the thread bobbin 2, and thus the LCP 180 does not rotate even though the lower thread is continued to be used—then the situation of the LTRER can be detected without using the LTERCP 112 at all.

In actuality, in the case of the thread bobbin 2 that is wound with the lower thread by the user, there is no adhesive put on the lower thread unlike the pre-wound bobbin that has been produced by thread bobbin manufacturers; therefore, when the lower thread is almost exhausted, the power of the lower thread winding the thread bobbin 2 is very loosened, thus the thread bobbin 2 may not need to be applied with a rotation load. However, in the case that the thread bobbin 2 is not applied with a rotation load, the thread bobbin 2 stops rotating only just right before the exhaustion of the lower thread. Therefore, in the case that the rotation speed of the SMM is fast, even though the user is notified that the thread bobbin 2 does not rotate almost before the exhaustion of the lower thread, there is a great possibility that the lower thread has been completely exhausted before the user stops the SMM (that is, after false stitchings have occurred). Therefore, in order to prevent false stitchings from happening, it is necessary to control the length of lower thread left on the thread bobbin 2 by using a similar form of the LTERCP 112, which has a restoring elasticity, used in the first embodiment. That is, in the case that the lower thread of the ending region 18 is unwound, the physical movement of the restoring elasticity of the LTERCP 112 loosens the lower thread left on the thread bobbin 2 and thus accelerates the weakening (loosening) of the power of the lower thread winding the thread bobbin 2. In this case, the contact groove 19 which supports the easy physical movement of the LTERCP 112 can be formed on one end region 20*b* or the middle section of the lower thread winding-spool. By the way, the LTERCP 112 can be installed on the RTPL 140 or the thread bobbin 2.

Like the various aforementioned embodiments, by utilizing the change in power of the lower thread winding the thread bobbin 2 when the lower thread of the ending region 18 is unwound, the situation of LTRER can be detected by only using the LCP 180 without having to use the LTERCP. Of course, as described above, the LTERCP 112 can be used to control the length of lower thread left on the thread bobbin 2.

By the way, even in the case of utilizing the change in power of the lower thread winding the thread bobbin 2, the situation of LTBB can be detected. Discerning whether the situation of the LTRER or the LTBB is dependent on whether the lower thread is continued to be used. That is, in the case that the LCP 180 does not rotate while the SMM rotates, if the lower thread is continued to be used and unwinds, then the situation of the LTRER has occurred; but if the lower thread is not being unwound, then the situation of the LTBB has occurred.

Figure 19A:
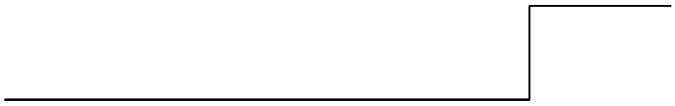
FIGS. 19A-19C are diagrams representing the logical pattern of the detection signals output from the LRU and the MRSU.
Figure 19B:
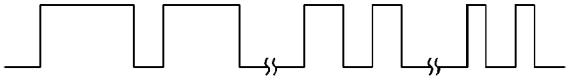

FIGS. 19A-19B illustrate the examples of the logical form of the detection signal output from the LRU 151 of the LTERDA. In actuality, the electricity current or voltage of the detection signal output from the LRU 151 appears in analog form depending on the amount, brightness, or wavelength of the light received; but here, it is illustrated as an electric signal changed to a DC (direct current) form, for the sake of convenience. In addition, although the detection signal can be output in the form of a certain digital data signal, for the sake of convenience, it is not illustrated. Furthermore, the changing in the detection signal of the LRU 151, due to the fast operation of the EH 1*a* or the sewing machine needle, is also not illustrated for the sake of convenience.

FIG. 19A is a simple illustration of the detection signal output from the LRU 151 in the case that the light is transferred out when the function of the LCM 115 is activated as the situation of the LTRER occurs. That is, in the case that the lower thread of the ending region 18 wound on the thread bobbin 2 is still left, the light is not transferred out because the function of the LCM 115 being inactivated, thus the output signal (electricity current or voltage) from the LRU 151 maintained in a low state; but if the lower thread of the ending region 18 is unwound, then the light is transferred outside, thus the output signal from the LRU 151 becomes a high state. Of course, the opposite signal pattern can be possible as well. Therefore, there is no limit or restriction regarding this in the present invention.

In the case that the situation of the LTRER occurs, if the function of the LCM 115 repetitively alternates between the state of activation and inactivation, then the end portion of the electric signal illustrated in FIG. 19A is toggled between the states of high and low.

FIG. 19B is a simple illustration of an example of the detection signal output from the LRU 151, in the case that the light is transferred outside when the function of the LCM 115 repetitively alternates between the state of activation and inactivation due to the rotation of the thread bobbin 2. If this detection signal does not repetitively toggle between high and low states, it is easily determined that the thread bobbin 2 is not rotating and has stopped. If the length of lower thread left on the thread bobbin 2 is long, the toggling cycle of the detection signal is long; but if the length of lower thread is reduced, the toggling cycle of the detection signal becomes shorter.

Figure 19C:
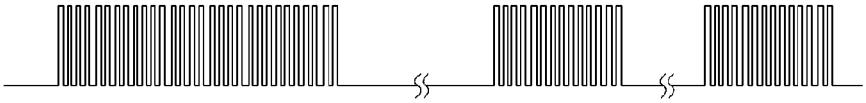

FIG. 19C illustrates an example of the logical form of the SMM rotation detection signal output from the MRSU 300.

The CNU 150 determines the situations of the LTRER and the LTBB by analyzing the detection signal output from the LRU 151 and the detection signal that notifies whether the SMM rotates, and outputs the result to the user through the speakers 152 and the display 153. In the case that the CNU 150 determines the situations of the LTRER or the LTBB, the CNU 150 can support the function of automatically blocking off the power supply to the SMM by additionally using a relay device, but it is not specifically restricted in the present patent.

By the way, the CNU 150 can also carry out various signal converting or amplifying processes on the detection signal output from the LRU 151 and the MRSU 300, but it is not specifically restricted in the present patent.

So far, various preferred embodiments of the present invention have been shown and described. Any person, who has a basic knowledge in the skill related to the present invention, can understand that the present invention can be implemented with various changes and modifications without departing from the sphere, principle, or spirit of the present invention. Therefore, the described embodiments with the accompanying drawings must be regarded from an explanation standpoint not a restriction standpoint. So, it is to be understood that the scope of the present invention is not limited to the described embodiments but it has the full scope defined by the language of the appended claims, and that all differences within the equivalent scope of the claims must be included in the present invention.

The invention claimed is:

1. A lower thread ending region detection apparatus (LTERDA) comprising: a light control unit (LCU), which contacts a part of lower thread of a thread bobbin comprising a bobbin core wound by the lower thread and activates or inactivates at least one of the functions of emitting light, reflecting light, passing or penetrating light, and blocking light, due to an effect of the physical movement force (PMF) generated depending on whether the lower thread of the ending region is unwound, wherein the bobbin core has no side plate;

a light receiving unit (LRU), which receives the light transferred out by the light control unit (LCU) and outputs a detection signal;

and a control and notification unit (CNU), which analyzes the detection signal output from the light receiving unit (LRU) to determine whether the lower thread has reached the ending region and outputs the result to the user.

2. The lower thread ending region detection apparatus (LTERDA) according to claim 1, wherein the light control unit (LCU) comprises: a lower thread ending region contacting part (LTERCP) which contacts the lower thread wound on the bobbin core and changes in position due to the effect of the physical movement force (PMF) generated depending on whether the lower thread of the ending region is unwound;

and at least one of the light control panels (LCPs) which are implemented with at least one of the following configurations: one type of light control means (LCM), multiple types of light control means (LCMs) performing different functions, multiple types of light control means (LCMs) performing the same function but different in wavelength or frequency, multiple types of light control means (LCMs) performing the same function with same wavelength or frequency but different in amount or brightness, and multiple light control means (LCMs); wherein the light control means (LCM) perform at least one of the functions of emitting light, reflecting light, passing or penetrating light, and blocking light;

and wherein if the lower thread ending region contacting part (LTERCP) changes in position, then at least one of the following actions of the light control means (LCM) implemented on the light control panel (LCP) is invoked: changing of the light control means (LCM)'s position, changing of the light control means (LCM)'s form, changing or rotating of the light control means (LCM)'s position due to the rotation of the thread bobbin, changing of the light control means (LCM)'s form due to the rotation of the thread bobbin, rotating of the light control panel (LCP) due to the rotation of the thread bobbin or no rotating of the light control panel (LCP) because of separation from the thread bobbin, and restricting of the light control panel (LCP)'s rotation; wherein the function of the light control means (LCM) is activated or inactivated depending on whether at least one of the actions is invoked.

3. The lower thread ending region detection apparatus (LTERDA) according to claim 2, wherein if the lower thread of the ending region is still left, then a specific function of the light control means (LCM) is maintained in a state of activation or inactivation, wherein if the lower thread of the ending region is unwound, then the lower thread ending region contacting part (LTERCP) changes in position that results in the specific function of the light control means (LCM) becoming reversed to the state of inactivation or activation, and wherein the control and notification unit (CNU) analyzes the detection signal output from the light receiving unit (LRU), and determines whether the lower thread has reached the ending region, and outputs the result to the user.

4. The lower thread ending region detection apparatus (LTERDA) according to claim 2, wherein if the lower thread of the ending region is still left, then a specific function of the light control means (LCM) is maintained in a state of activation or inactivation, wherein if the lower thread of the ending region is unwound, then the lower thread ending region contacting part (LTERCP) changes in position that results in the specific function of the light control means (LCM) repetitively alternating between the state of activation and inactivation due to the rotation of the thread bobbin, and wherein the control and notification unit (CNU) analyzes the detection signal output from the light receiving unit (LRU), and determines whether the lower thread has reached the ending region, and outputs the result to the user.

5. The lower thread ending region detection apparatus (LTERDA) according to claim 2, wherein if the lower thread of the ending region is still left, then a specific function of the light control means (LCM) repetitively alternates between the state of activation and inactivation due to the rotation of the thread bobbin, wherein if the lower thread of the ending region is unwound, then the lower thread ending region contacting part (LTERCP) changes in position that results in restricting the specific function of the light control means (LCM) from alternating between the state of activation and inactivation even though the thread bobbin is still rotating, wherein the control and notification unit (CNU) determines whether a sewing machine motor (SMM) rotates by analyzing a detection signal that notifies the rotation of the sewing machine motor (SMM), and whether the specific function of the light control means (LCM) repetitively alternates between the state of activation and inactivation (i.e. whether the light control panel (LCP) rotates) by analyzing the detection signal output from the light receiving unit (LRU), and wherein if it is determined that the sewing machine motor (SMM) rotates while the light control panel (LCP) does not rotate, then the control and notification unit (CNU) determines that at least one of the situations between the lower thread reaching the ending region (LTRER) and the lower thread being broken (LTBB) has occurred, and outputs the result to the user.

6. The lower thread ending region detection apparatus (LTERDA) according to claim 5, wherein the control and notification unit (CNU) comprises a motor rotation sensing unit (MRSU), which includes a sensing device that detects the rotation of the sewing machine motor (SMM).

7. The lower thread ending region detection apparatus (LTERDA) according to claim 6, wherein the motor rotation sensing unit (MRSU) comprising: at least one magnet, which is installed on at least one of the places of the belt driving axle of the motor, the belt of the motor, and the turning wheel of the sewing machine; and a magnetic sensor, which outputs an electric signal that changes in amount of voltage or electric current due to the magnetic field of at least one of the magnets, and wherein the control and notification unit (CNU) determines whether the sewing machine motor (SMM) rotates by analyzing the electric signal output from the magnetic sensor.

8. The lower thread ending region detection apparatus (LTERDA) according to claim 5, wherein a hook, which rotates or moves back and forth due to the rotation of the sewing machine motor (SMM), partially obstructs the light transferred to the light control unit (LCU) or the light transferred to the light receiving unit (LRU) from the light control unit (LCU), causing changes in the pattern of the light received by the light receiving unit (LRU) every time the hook rotates or moves back and forth, and wherein the control and notification unit (CNU) determines whether the sewing machine motor (SMM) rotates by analyzing the pattern of the detection signal output from the light receiving unit (LRU).

9. The lower thread ending region detection apparatus (LTERDA) according to claim 2, further comprising a light emitting unit (LEU), which illuminates light to the light control panel (LCP), wherein the light control panel (LCP) includes at least one of the following light control means (LCMs): light control means (LCM) performing the function of reflecting light, light control means (LCM) performing the function of passing or penetrating light, and light control means (LCM) performing the function of blocking light.

10. The lower thread ending region detection apparatus (LTERDA) according to claim 2, further comprising at least one side board which is used for the thread bobbin, wherein the light control panel (LCP) is attached, installed, or formed on at least one side of the side board.

11. The lower thread ending region detection apparatus (LTERDA) according to claim 2, further comprising a rotating plate (RTPL), which is combined with or attached to the thread bobbin in an attachable and detachable manner, wherein the light control panel (LCP) is attached, installed, or formed on the rotating plate (RTPL).

12. The lower thread ending region detection apparatus (LTERDA) according to claim 2, further comprising a rotating plate (RTPL), which is combined with or attached to the thread bobbin in an attachable and detachable manner, wherein the lower thread ending region contacting part (LTERCP) is installed on at least one of the following: the bobbin core and the rotating plate (RTPL).

13. The lower thread ending region detection apparatus (LTERDA) according to claim 2, further comprising a fixed plate (FXPL), which does not rotate with the thread bobbin, wherein the light control panel (LCP) is attached, installed, or formed on the fixed plate (FXPL).

14. The lower thread ending region detection apparatus (LTERDA) according to claim 2, further comprising: a rotating plate (RTPL), which is combined with or attached to the thread bobbin in an attachable and detachable manner;

and a fixed plate (FXPL), which does not rotate with the thread bobbin, wherein the light control panel (LCP) is attached, installed, or formed on at least one side of the following: the bobbin core, the rotating plate (RTPL), and the fixed plate (FXPL).

15. The lower thread ending region detection apparatus (LTERDA) according to claim 1, wherein the bobbin core is formed with at least one contact groove.

16. The lower thread ending region detection apparatus (LTERDA) according to claim 1, further comprising a rotating plate (RTPL), which is combined with or attached to the thread bobbin in an attachable and detachable manner.

17. The lower thread ending region detection apparatus (LTERDA) according to claim 16, wherein a thread bobbin parking part (TBPP), which is inserted into the bobbin spindle hole (BSH) of the bobbin core, is installed on one side of the rotating plate (RTPL).

18. The lower thread ending region detection apparatus (LTERDA) according to claim 17, wherein the thread bobbin parking part (TBPP) is formed to have the bobbin core insertion supporting structure (BCISS), which supports the stable combination with the bobbin core.

19. The lower thread ending region detection apparatus (LTERDA) according to claim 18, wherein the inner surface of the bobbin spindle hole (BSH) of the bobbin core is formed to have the parking part insertion structure (PPIS) that has a shape corresponding to the shape of the bobbin core insertion supporting structure (BCISS) of the thread bobbin parking part (TBPP).

20. The lower thread ending region detection apparatus (LTERDA) according to claim 17, wherein one or more contact grooves are formed on the bobbin core, and wherein the lower thread wound on the bobbin core physically contacts the thread bobbin parking part (TBPP) of the rotating plate (RTPL) through the contact grooves formed on the bobbin core, inside which the thread bobbin parking part (TBPP) is located.

21. A lower thread ending region detection apparatus (LTERDA) comprising: a light control unit (LCU), which carries out at least one of the functions of emitting light, reflecting light, passing or penetrating light and blocking light, and is constructed so that it rotates during the usage of a part of lower thread of a thread bobbin comprising at least one between a bobbin core wound by the lower thread and a bobbin wound by the lower thread due to the effect of the physical bearing power (PBP) of the lower thread if the lower thread of the ending region is still left, while it does not rotate despite the continual usage of the lower thread if the physical bearing power (PBP) becomes less than a certain level as the lower thread of the ending region is unwound, wherein the bobbin core has no side plate while the bobbin has two side plates;

a light receiving unit (LRU), which receives the light transferred out by the light control unit (LCU) and outputs a detection signal;

and a control and notification unit (CNU), which determines whether a sewing machine motor (SMM) rotates by analyzing a detection signal that notifies the rotation of the sewing machine motor (SMM), whether the light control unit (LCU) rotates by analyzing the detection signal output from the light receiving unit (LRU), and whether the lower thread has reached the ending region based on determinations of both the sewing machine motor (SMM)'s rotation and the light control unit (LCU)'s rotation, and outputs the result to the user.

22. The lower thread ending region detection apparatus (LTERDA) according to claim 21, wherein the bobbin core is formed with at least one contact groove.

23. The lower thread ending region detection apparatus (LTERDA) according to claim 21, wherein the light control unit (LCU) comprises at least one of the light control panels (LCPs), which are implemented with at least one of the following configurations: one type of light control means (LCM), multiple types of light control means (LCMs) performing different functions, multiple types of light control means (LCMs) performing the same function but different in wavelength or frequency, multiple types of light control means (LCMs) performing the same function with same wavelength or frequency but different in amount or brightness, and multiple light control means (LCMs); wherein the light control means (LCM) perform at least one of the functions of emitting light, reflecting light, passing or penetrating light, and blocking light;

and wherein if the control and notification unit (CNU) determines that the sewing machine motor (SMM) rotates by analyzing the detection signal that notifies the rotation of the sewing machine motor (SMM), while determining that the light control panel (LCP) no longer rotates because a specific function of the light control means (LCM) does not repetitively alternate between the state of activation and inactivation, then it determines that at least one of the situations between the lower thread reaching the ending region (LTRER) and the lower thread being broken (LTBB) has occurred, and outputs the result to the user.

24. The lower thread ending region detection apparatus (LTERDA) according to claim 23, further comprising at least one side board which is used for the thread bobbin comprising the bobbin core wound by the lower thread, wherein the light control panel (LCP) is attached, installed, or formed on at least one side of the side board.

25. The lower thread ending region detection apparatus (LTERDA) according to claim 23, wherein the light control panel (LCP) is attached, installed, or formed on at least one side of the side plate of the bobbin.

26. The lower thread ending region detection apparatus (LTERDA) according to claim 23, wherein the light control unit (LCU) comprises at least one of the lower thread ending region contacting parts (LTERCPs), which contact or are inserted into at least a portion of the lower thread wound on the bobbin core, and are constructed in order to combine or attach the light control unit (LCU) with at least a portion of the lower thread wound on the bobbin core in an attachable and detachable manner, wherein in the case that the lower thread of the ending region is still left, as the lower thread's physical bearing power (PBP), which sustains the lower thread ending region contacting part (LTERCP), becomes greater than a certain level, the light control panel (LCP) rotates with the thread bobbin resulting in a specific function of the light control means (LCM) repetitively alternating between the state of activation and inactivation, and wherein in the case that the lower thread of the ending region is unwound, as the lower thread's physical bearing power (PBP) becomes less than the certain level, the light control panel (LCP) separates from the thread bobbin resulting in a specific function of the light control means (LCM) not repetitively alternating between the state of activation and inactivation, even though the thread bobbin is still rotating.

27. The lower thread ending region detection apparatus (LTERDA) according to claim 23, wherein the light control unit (LCU) includes an adhesive material constructed to stick the light control panel (LCP) to at least a portion of the lower thread wound on the bobbin core, wherein in the case that the lower thread of the ending region is still left, as the lower thread's physical bearing power (PBP) that makes the adhesive material work becomes greater than a certain level, the light control panel (LCP) rotates with the thread bobbin resulting in a specific function of the light control means (LCM) repetitively alternating between the state of activation and inactivation, and wherein in the case that the lower thread of the ending region is unwound, as the lower thread's physical bearing power (PBP) becomes less than the certain level, the light control panel (LCP) separates from the thread bobbin resulting in a specific function of the light control means (LCM) not repetitively alternating between the state of activation and inactivation, even though the thread bobbin is still rotating.

28. The lower thread ending region detection apparatus (LTERDA) according to claim 23, wherein in the case that the lower thread of the ending region is still left, as the physical bearing power (PBP) of the lower thread winding the thread bobbin becomes greater than a certain level, the light control panel (LCP) lets a specific function of the light control means (LCM) repetitively alternate between the state of activation and inactivation during the lower thread usage, and wherein in the case that the lower thread of the ending region is unwound, as the physical bearing power (PBP) of the lower thread winding the thread bobbin loosens, the light control panel (LCP) no longer rotates resulting in a specific function of the light control means (LCM) not repetitively alternating between the state of activation and inactivation, even though the lower thread is still continued to be used.

29. The lower thread ending region detection apparatus (LTERDA) according to claim 28, wherein the thread bobbin comprises: a lower thread winding-spool; and a tube which surrounds at least a portion of the outer surface of the bobbin spindle hole (BSH) of the lower thread winding-spool, and wherein at least a portion of the lower thread is wound on the tube.

30. The lower thread ending region detection apparatus (LTERDA) according to claim 29, wherein one or more contact grooves are formed on the tube, and the lower thread wound on the tube physically contacts the outer surface of the bobbin spindle hole (BSH) of the lower thread winding-spool through the contact grooves formed on the tube, inside which the outer surface of the bobbin spindle hole (BSH) of the lower thread winding-spool is located.

31. The lower thread ending region detection apparatus (LTERDA) according to claim 29, wherein the tube is made of elastic material that can be compressed or restored depending on the amount of lower thread wound on it.

32. The lower thread ending region detection apparatus (LTERDA) according to claim 28, further comprising a rotation load generation mechanism (RLGM) which generates a certain rotation load that tries to resist the rotation of the thread bobbin by at least one of the forces of magnetism and friction.

33. A bobbin core, which is a component of a thread bobbin used in a lower thread ending region detection apparatus (LTERDA), comprising:

a cylindrical body formed with a bobbin spindle hole (BSH), wherein on the inner surface of the bobbin spindle hole (BSH) of the cylindrical body, a parking part insertion structure (PPIS) is formed to allow a thread bobbin parking part (TBPP), which is installed on a rotating plate (RTPL) that is used in the lower thread ending region detection apparatus (LTERDA) and supports the function of detecting whether a part of lower thread wound on the bobbin core has reached its ending region or the lower thread has been broken, to be easily inserted.

34. A bobbin core, which is a component of a thread bobbin used in a lower thread ending region detection apparatus (LTERDA), comprising:

a cylindrical body formed with a bobbin spindle hole (BSH), wherein one or more contact grooves are formed on at least a portion of the cylindrical body to allow a part of lower thread wound above the contact grooves to physically contact at least one of the followings: lower thread ending region contacting parts (LTERCPs) of a rotating plate (RTPL) and a thread bobbin parking part (TBPP) of a rotating plate (RTPL); wherein the rotating plate (RTPL) is used in the lower thread ending region detection apparatus (LTERDA).

35. A bobbin, which is a component of a thread bobbin used in a lower thread ending region detection apparatus (LTERDA), comprising:

a cylindrical body formed with a bobbin spindle hole (BSH);

at least one side plate fixed to the sides of the cylindrical body; and a tube that is made as a form surrounding at least a portion of the outer surface of the cylindrical body, and is wound with at least a portion of lower thread;

wherein on the side plate, a light control panel (LCP) that is used in the lower thread ending region detection apparatus (LTERDA) is installed, attached, or formed, and wherein the side plate as well as the light control panel (LCP) does not rotate or rotates with the tube depending on whether the lower thread of the ending region wound on the tube is unwound or not.

36. The bobbin according to claim 35, wherein one or more contact grooves are formed on the tube, and at least a portion of the lower thread wound on the tube physically contacts an outer surface of the bobbin spindle hole (BSH) of the cylindrical body through the contact grooves formed on the tube, inside which the outer surface of the bobbin spindle hole (BSH) of the cylindrical body is located.

37. The bobbin according to claim 35, wherein a fitting part or a slot is formed on the side plate to prevent false rotations of the tube when the lower thread is wound on the tube.

* * * * *